US011022119B2

(12) United States Patent
Perevozchikov et al.

(10) Patent No.: US 11,022,119 B2
(45) Date of Patent: Jun. 1, 2021

(54) VARIABLE VOLUME RATIO COMPRESSOR

(71) Applicant: Emerson Climate Technologies, Inc., Sidney, OH (US)

(72) Inventors: Michael M. Perevozchikov, Tipp City, OH (US); Kirill M. Ignatiev, Sidney, OH (US); Roy J. Doepker, Lima, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 207 days.

(21) Appl. No.: 16/147,920

(22) Filed: Oct. 1, 2018

(65) Prior Publication Data

US 2019/0101120 A1 Apr. 4, 2019

Related U.S. Application Data

(60) Provisional application No. 62/567,277, filed on Oct. 3, 2017.

(51) Int. Cl.
*F04C 28/16* (2006.01)
*F04C 18/02* (2006.01)
(Continued)

(52) U.S. Cl.
CPC ..... *F04C 28/16* (2013.01); *F04C 18/0215* (2013.01); *F04C 18/0261* (2013.01);
(Continued)

(58) Field of Classification Search
CPC ..... F04C 18/0215; F04C 18/0253; F04C 18/0261; F04C 23/008; F04C 28/16;
(Continued)

(56) References Cited

U.S. PATENT DOCUMENTS 4,058,988 A 11/1977 Shaw
4,216,661 A 8/1980 Tojo et al.
(Continued)

FOREIGN PATENT DOCUMENTS

CN 1137614 A 12/1996
CN 1158944 A 9/1997
(Continued)

OTHER PUBLICATIONS

Office Action regarding Chinese Patent Application No. 201710795228.8, dated Oct. 28, 2019. Translation provided by Unitalen Attorneys at Law.

(Continued)

*Primary Examiner* — Devon C Kramer
*Assistant Examiner* — David N Brandt
(74) *Attorney, Agent, or Firm* — Hamess, Dickey & Pierce, P.L.C.

(57) ABSTRACT

A compressor may include a shell assembly, first and second scrolls, and a valve assembly. The shell assembly may define a discharge chamber. The first scroll may be disposed within the discharge chamber and may include a first end plate and a first spiral wrap. The first end plate may include a discharge passage in communication with the discharge chamber. The second scroll may be disposed within the discharge chamber and may include a second end plate and a second spiral wrap. The first and second spiral wraps define fluid pockets therebetween. The second end plate may include a port selectively communicating with one of the fluid pockets. The valve assembly may be mounted to the second scroll and may include a valve member that is movable between open and closed positions to allow and restrict communication between the port and the discharge chamber.

28 Claims, 10 Drawing Sheets

(51) Int. Cl.
*F04C 28/24* (2006.01)
*F04C 23/00* (2006.01)
*F01C 21/00* (2006.01)

(52) U.S. Cl.
CPC ..... *F04C 28/24* (2013.01); *F01C 2021/165* (2013.01); *F01C 2021/1643* (2013.01); *F04C 23/008* (2013.01)

(58) Field of Classification Search
CPC ..... F04C 28/18; F04C 28/24; F01C 21/186; F01C 2021/14; F01C 2021/16; F01C 2021/1618; F01C 2021/1625; F01C 2021/1643; F01C 2021/165
See application file for complete search history.

(56) References Cited

U.S. PATENT DOCUMENTS 4,382,370 A 5/1983 Suefuji et al.
4,383,805 A 5/1983 Teegarden et al.
4,389,171 A 6/1983 Eber et al.
4,466,784 A 8/1984 Hiraga
4,475,360 A 10/1984 Suefuji et al.
4,475,875 A 10/1984 Sugimoto et al.
4,496,296 A * 1/1985 Arai ..... F04C 18/0215 417/440
4,497,615 A 2/1985 Griffith
4,545,742 A 10/1985 Schaefer
4,547,138 A 10/1985 Mabe et al.
4,552,518 A 11/1985 Utter
4,564,339 A 1/1986 Nakamura et al.
4,580,949 A 4/1986 Maruyama et al.
4,609,329 A 9/1986 Pillis et al.
4,650,405 A 3/1987 Iwanami et al.
4,696,630 A 9/1987 Sakata et al.
4,727,725 A 3/1988 Nagata et al.
4,772,188 A 9/1988 Kimura et al.
4,774,816 A 10/1988 Uchikawa et al.
4,818,195 A 4/1989 Murayama et al.
4,824,344 A 4/1989 Kimura et al.
4,838,773 A 6/1989 Noboru
4,842,499 A 6/1989 Nishida et al.
4,846,633 A 7/1989 Suzuki et al.
4,877,382 A 10/1989 Caillat et al.
4,886,425 A 12/1989 Itahana et al.
4,886,433 A 12/1989 Maier
4,898,520 A 2/1990 Nieter et al.
4,927,339 A 5/1990 Riffe et al.
4,940,395 A 7/1990 Yamamoto et al.
4,954,057 A 9/1990 Caillat et al.
4,990,071 A 2/1991 Sugimoto
4,997,349 A 3/1991 Richardson, Jr.
5,024,589 A 6/1991 Jetzer et al.
5,040,952 A 8/1991 Inoue et al.
5,040,958 A 8/1991 Arata et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
5,098,265 A 3/1992 Machida et al.
5,145,346 A 9/1992 Iio et al.
5,152,682 A 10/1992 Morozumi et al.
RE34,148 E 12/1992 Terauchi et al.
5,169,294 A 12/1992 Barito
5,171,141 A 12/1992 Morozumi et al.
5,192,195 A 3/1993 Iio et al.
5,193,987 A 3/1993 Iio et al.
5,199,862 A 4/1993 Kondo et al.
5,213,489 A 5/1993 Kawahara et al.
5,240,389 A 8/1993 Oikawa et al.
5,253,489 A 10/1993 Yoshii
5,304,047 A 4/1994 Shibamoto
5,318,424 A 6/1994 Bush et al.
5,330,463 A 7/1994 Hirano
5,336,068 A 8/1994 Sekiya et al.
5,340,287 A 8/1994 Kawahara et al.
5,356,271 A 10/1994 Miura et al.
5,411,384 A 5/1995 Bass et al.
5,425,626 A 6/1995 Tojo et al.
5,427,512 A 6/1995 Kohsokabe et al.
5,451,146 A 9/1995 Inagaki et al.
5,458,471 A 10/1995 Ni
5,458,472 A 10/1995 Kobayashi et al.
5,482,637 A 1/1996 Rao et al.
5,511,959 A 4/1996 Tojo et al.
5,547,354 A 8/1996 Shimizu et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,591,014 A 1/1997 Wallis et al.
5,607,288 A 3/1997 Wallis et al.
5,611,674 A 3/1997 Bass et al.
5,613,841 A 3/1997 Bass et al.
5,624,247 A 4/1997 Nakamura
5,639,225 A 6/1997 Matsuda et al.
5,640,854 A 6/1997 Fogt et al.
5,649,817 A 7/1997 Yamazaki
5,660,539 A 8/1997 Matsunaga et al.
5,674,058 A 10/1997 Matsuda et al.
5,678,985 A 10/1997 Brooke et al.
5,707,210 A 1/1998 Ramsey et al.
5,722,257 A 3/1998 Ishii et al.
5,741,120 A 4/1998 Bass et al.
5,775,893 A 7/1998 Takao et al.
5,842,843 A 12/1998 Haga
5,855,475 A 1/1999 Fujio et al.
5,885,063 A 3/1999 Makino et al.
5,888,057 A 3/1999 Kitano et al.
5,938,417 A 8/1999 Takao et al.
5,993,171 A 11/1999 Higashiyama
5,993,177 A 11/1999 Terauchi et al.
6,030,192 A 2/2000 Hill et al.
6,047,557 A 4/2000 Pham et al.
6,068,459 A 5/2000 Clarke et al.
6,086,335 A 7/2000 Bass et al.
6,093,005 A 7/2000 Nakamura
6,095,765 A 8/2000 Khalifa
6,102,671 A 8/2000 Yamamoto et al.
6,123,517 A 9/2000 Brooke et al.
6,123,528 A 9/2000 Sun et al.
6,132,179 A 10/2000 Higashiyama
6,139,287 A 10/2000 Kuroiwa et al.
6,139,291 A 10/2000 Perevozchikov
6,149,401 A 11/2000 Iwanami et al.
6,152,714 A 11/2000 Mitsuya et al.
6,164,940 A 12/2000 Terauchi et al.
6,174,149 B1 1/2001 Bush
6,176,686 B1 1/2001 Wallis et al.
6,179,589 B1 1/2001 Bass et al.
6,202,438 B1 3/2001 Barito
6,210,120 B1 4/2001 Hugenroth et al.
6,213,731 B1 4/2001 Doepker et al.
6,231,316 B1 5/2001 Wakisaka et al.
6,257,840 B1 7/2001 Ignatiev et al.
6,264,444 B1 7/2001 Nakane et al.
6,267,565 B1 7/2001 Seibel et al.
6,273,691 B1 8/2001 Morimoto et al.
6,280,154 B1 8/2001 Clendenin et al.
6,290,477 B1 9/2001 Gigon
6,293,767 B1 9/2001 Bass
6,293,776 B1 9/2001 Hahn et al.
6,309,194 B1 10/2001 Fraser et al.
6,322,340 B1 11/2001 Itoh et al.
6,338,912 B1 1/2002 Ban et al.
6,350,111 B1 2/2002 Perevozchikov et al.
6,361,890 B1 3/2002 Ban et al.
6,379,123 B1 4/2002 Makino et al.
6,389,837 B1 5/2002 Morozumi
6,412,293 B1 7/2002 Pham et al.
6,413,058 B1 7/2002 Williams et al.
6,419,457 B1 7/2002 Seibel et al.

(56) References Cited

U.S. PATENT DOCUMENTS 6,428,286 B1 8/2002 Shimizu et al.
6,454,551 B2 9/2002 Kuroki et al.
6,457,948 B1 10/2002 Pham
6,464,481 B2 10/2002 Tsubai et al.
6,478,550 B2 11/2002 Matsuba et al.
6,506,036 B2 1/2003 Tsubai et al.
6,514,060 B1 * 2/2003 Ishiguro ..... F04C 29/0035 418/55.5
6,537,043 B1 3/2003 Chen
6,544,016 B2 4/2003 Gennami et al.
6,558,143 B2 5/2003 Nakajima et al.
6,589,035 B1 7/2003 Tsubono et al.
6,619,062 B1 9/2003 Shibamoto et al.
6,679,683 B2 1/2004 Seibel et al.
6,705,848 B2 3/2004 Scancarello
6,715,999 B2 4/2004 Ancel et al.
6,746,223 B2 6/2004 Manole
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 4/2005 Shibamoto et al.
6,884,042 B2 4/2005 Zili et al.
6,887,051 B2 5/2005 Sakuda et al.
6,893,229 B2 5/2005 Choi et al.
6,896,493 B2 5/2005 Chang et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,118,358 B2 10/2006 Tsubono et al.
7,137,796 B2 11/2006 Tsubono et al.
7,160,088 B2 1/2007 Peyton
7,172,395 B2 2/2007 Shibamoto et al.
7,207,787 B2 4/2007 Liang et al.
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
7,371,059 B2 5/2008 Ignatiev et al.
RE40,399 E 6/2008 Hugenroth et al.
RE40,400 E 6/2008 Bass et al.
7,393,190 B2 7/2008 Lee et al.
7,404,706 B2 7/2008 Ishikawa et al.
RE40,554 E 10/2008 Bass et al.
7,510,382 B2 3/2009 Jeong
7,547,202 B2 6/2009 Knapke
7,695,257 B2 4/2010 Joo et al.
7,717,687 B2 5/2010 Reinhart
7,771,178 B2 8/2010 Perevozchikov et al.
7,802,972 B2 9/2010 Shimizu et al.
7,815,423 B2 10/2010 Guo et al.
7,891,961 B2 2/2011 Shimizu et al.
7,896,629 B2 3/2011 Ignatiev et al.
RE42,371 E 5/2011 Peyton
7,956,501 B2 6/2011 Jun et al.
7,967,582 B2 6/2011 Akei et al.
7,967,583 B2 6/2011 Stover et al.
7,972,125 B2 7/2011 Stover et al.
7,976,289 B2 7/2011 Masao
7,976,295 B2 7/2011 Stover et al.
7,988,433 B2 8/2011 Akei et al.
7,988,434 B2 8/2011 Stover et al.
8,025,492 B2 9/2011 Seibel et al.
8,303,278 B2 11/2012 Roof et al.
8,303,279 B2 11/2012 Hahn
8,308,448 B2 11/2012 Fields et al.
8,328,531 B2 12/2012 Milliff et al.
8,393,882 B2 3/2013 Ignatiev et al.
8,506,271 B2 8/2013 Seibel et al.
8,517,703 B2 8/2013 Doepker
8,585,382 B2 11/2013 Akei et al.
8,616,014 B2 12/2013 Stover et al.
8,790,098 B2 7/2014 Stover et al.
8,840,384 B2 9/2014 Patel et al.
8,857,200 B2 10/2014 Stover et al.
8,932,036 B2 1/2015 Monnier et al.
9,127,677 B2 9/2015 Doepker
9,145,891 B2 9/2015 Kim et al.
9,249,802 B2 2/2016 Doepker et al.
9,303,642 B2 4/2016 Akei et al.
9,435,340 B2 9/2016 Doepker et al.
9,494,157 B2 11/2016 Doepker
9,541,084 B2 * 1/2017 Ignatiev ..... F04C 23/008
9,605,677 B2 3/2017 Heidecker et al.
9,624,928 B2 4/2017 Yamazaki et al.
9,651,043 B2 5/2017 Stover et al.
9,777,730 B2 10/2017 Doepker et al.
9,790,940 B2 10/2017 Doepker et al.
9,879,674 B2 1/2018 Akei et al.
9,989,057 B2 6/2018 Lochner et al.
10,066,622 B2 9/2018 Pax et al.
10,087,936 B2 10/2018 Pax et al.
10,094,380 B2 10/2018 Doepker et al.
2001/0010800 A1 8/2001 Kohsokabe et al.
2002/0039540 A1 4/2002 Kuroki et al.
2002/0057975 A1 5/2002 Nakajima et al.
2003/0044296 A1 3/2003 Chen
2003/0044297 A1 3/2003 Gennami et al.
2003/0186060 A1 10/2003 Rao
2003/0228235 A1 12/2003 Sowa et al.
2004/0126259 A1 7/2004 Choi et al.
2004/0136854 A1 7/2004 Kimura et al.
2004/0146419 A1 7/2004 Kawaguchi et al.
2004/0170509 A1 9/2004 Wehrenberg et al.
2004/0184932 A1 9/2004 Lifson
2004/0197204 A1 10/2004 Yamanouchi et al.
2005/0019177 A1 1/2005 Shin et al.
2005/0019178 A1 1/2005 Shin et al.
2005/0053507 A1 3/2005 Takeuchi et al.
2005/0069444 A1 3/2005 Peyton
2005/0140232 A1 6/2005 Lee et al.
2005/0201883 A1 9/2005 Clendenin et al.
2005/0214148 A1 9/2005 Ogawa et al.
2006/0099098 A1 5/2006 Lee et al.
2006/0138879 A1 6/2006 Kusase et al.
2006/0198748 A1 9/2006 Grassbaugh et al.
2006/0228243 A1 10/2006 Sun et al.
2006/0233657 A1 10/2006 Bonear et al.
2007/0036661 A1 2/2007 Stover
2007/0110604 A1 5/2007 Peyton
2007/0130973 A1 6/2007 Lifson et al.
2008/0115357 A1 5/2008 Li et al.
2008/0138227 A1 6/2008 Knapke
2008/0159892 A1 7/2008 Huang et al.
2008/0159893 A1 7/2008 Caillat
2008/0196445 A1 8/2008 Lifson et al.
2008/0223057 A1 9/2008 Lifson et al.
2008/0226483 A1 9/2008 Iwanami et al.
2008/0305270 A1 12/2008 Uhlianuk et al.
2009/0035167 A1 2/2009 Sun
2009/0068048 A1 3/2009 Stover et al.
2009/0071183 A1 3/2009 Stover et al.
2009/0185935 A1 7/2009 Seibel et al.
2009/0191080 A1 7/2009 Ignatiev et al.
2009/0297377 A1 12/2009 Stover et al.
2009/0297378 A1 12/2009 Stover et al.
2009/0297379 A1 12/2009 Stover et al.
2009/0297380 A1 12/2009 Stover et al.
2010/0111741 A1 5/2010 Chikano et al.
2010/0135836 A1 6/2010 Stover et al.
2010/0158731 A1 6/2010 Akei et al.
2010/0209278 A1 8/2010 Tarao et al.
2010/0212311 A1 8/2010 McQuary et al.
2010/0212352 A1 8/2010 Kim et al.
2010/0254841 A1 10/2010 Akei et al.

(56) References Cited

U.S. PATENT DOCUMENTS

| | | | | |
|---|---|---|---|---|
| 2010/0300659 | A1 | 12/2010 | Stover et al. | |
| 2010/0303659 | A1 | 12/2010 | Stover et al. | |
| 2011/0135509 | A1 | 6/2011 | Fields et al. | |
| 2011/0206548 | A1 | 8/2011 | Doepker | |
| 2011/0243777 | A1 | 10/2011 | Ito et al. | |
| 2011/0250085 | A1 | 10/2011 | Stover et al. | |
| 2011/0293456 | A1 | 12/2011 | Seibel et al. | |
| 2012/0009076 | A1 | 1/2012 | Kim et al. | |
| 2012/0107163 | A1 | 5/2012 | Monnier et al. | |
| 2012/0183422 | A1 | 7/2012 | Bahmata | |
| 2012/0195781 | A1 | 8/2012 | Stover et al. | |
| 2013/0078128 | A1 | 3/2013 | Akei | |
| 2013/0089448 | A1 | 4/2013 | Ginies et al. | |
| 2013/0094987 | A1 | 4/2013 | Yamashita et al. | |
| 2013/0121857 | A1 | 5/2013 | Liang et al. | |
| 2013/0177465 | A1* | 7/2013 | Clendenin | F04C 29/00 418/55.1 |
| 2013/0302198 | A1 | 11/2013 | Ginies et al. | |
| 2013/0309118 | A1 | 11/2013 | Ginies et al. | |
| 2013/0315768 | A1 | 11/2013 | Le Coat et al. | |
| 2014/0023540 | A1 | 1/2014 | Heidecker et al. | |
| 2014/0024563 | A1 | 1/2014 | Heidecker et al. | |
| 2014/0037486 | A1 | 2/2014 | Stover et al. | |
| 2014/0134030 | A1 | 5/2014 | Stover et al. | |
| 2014/0134031 | A1 | 5/2014 | Doepker et al. | |
| 2014/0147294 | A1 | 5/2014 | Fargo et al. | |
| 2014/0154121 | A1* | 6/2014 | Doepker | F04C 23/008 418/22 |
| 2014/0154124 | A1 | 6/2014 | Doepker et al. | |
| 2014/0219846 | A1 | 8/2014 | Ignatiev et al. | |
| 2015/0037184 | A1 | 2/2015 | Rood et al. | |
| 2015/0086404 | A1 | 3/2015 | Kiem et al. | |
| 2015/0192121 | A1 | 7/2015 | Sung et al. | |
| 2015/0330386 | A1 | 11/2015 | Doepker | |
| 2015/0345493 | A1 | 12/2015 | Lochner et al. | |
| 2015/0354719 | A1 | 12/2015 | van Beek et al. | |
| 2016/0025093 | A1 | 1/2016 | Doepker | |
| 2016/0025094 | A1 | 1/2016 | Ignatiev et al. | |
| 2016/0032924 | A1* | 2/2016 | Stover | F04C 27/005 418/55.5 |
| 2016/0047380 | A1 | 2/2016 | Kim et al. | |
| 2016/0053759 | A1 | 2/2016 | Choi et al. | |
| 2016/0076543 | A1 | 3/2016 | Akei et al. | |
| 2016/0115954 | A1 | 4/2016 | Doepker et al. | |
| 2016/0138879 | A1 | 5/2016 | Matsukado et al. | |
| 2016/0201673 | A1 | 7/2016 | Perevozchikov et al. | |
| 2016/0208803 | A1 | 7/2016 | Uekawa et al. | |
| 2017/0002817 | A1 | 1/2017 | Stover | |
| 2017/0002818 | A1 | 1/2017 | Stover | |
| 2017/0030354 | A1 | 2/2017 | Stover | |
| 2017/0241417 | A1 | 8/2017 | Jin et al. | |
| 2017/0268510 | A1 | 9/2017 | Stover et al. | |
| 2017/0306960 | A1 | 10/2017 | Pax et al. | |
| 2017/0314558 | A1 | 11/2017 | Pax et al. | |
| 2017/0342978 | A1 | 11/2017 | Doepker | |
| 2017/0342983 | A1 | 11/2017 | Jin et al. | |
| 2017/0342984 | A1 | 11/2017 | Jin et al. | |
| 2018/0023570 | A1 | 1/2018 | Huang et al. | |
| 2018/0038369 | A1 | 2/2018 | Doepker et al. | |
| 2018/0038370 | A1 | 2/2018 | Doepker et al. | |
| 2018/0066656 | A1 | 3/2018 | Perevozchikov et al. | |
| 2018/0066657 | A1 | 3/2018 | Perevozchikov et al. | |
| 2018/0149155 | A1 | 5/2018 | Akei et al. | |
| 2018/0223823 | A1 | 8/2018 | Ignatiev et al. | |
| 2019/0040861 | A1 | 2/2019 | Doepker et al. | |
| 2019/0186491 | A1 | 6/2019 | Perevozchikov et al. | |
| 2019/0203709 | A1 | 7/2019 | Her et al. | |
| 2019/0353164 | A1 | 11/2019 | Berning et al. | |

FOREIGN PATENT DOCUMENTS

| | | | |
|---|---|---|---|
| CN | 1158945 | A | 9/1997 |
| CN | 1177681 | A | 4/1998 |
| CN | 1177683 | A | 4/1998 |
| CN | 1259625 | A | 7/2000 |
| CN | 1286358 | A | 3/2001 |
| CN | 1289011 | A | 3/2001 |
| CN | 1339087 | A | 3/2002 |
| CN | 1349053 | A | 5/2002 |
| CN | 1382912 | A | 12/2002 |
| CN | 1407233 | A | 4/2003 |
| CN | 1407234 | A | 4/2003 |
| CN | 1517553 | A | 8/2004 |
| CN | 1601106 | A | 3/2005 |
| CN | 1680720 | A | 10/2005 |
| CN | 1702328 | A | 11/2005 |
| CN | 2747381 | Y | 12/2005 |
| CN | 1757925 | A | 4/2006 |
| CN | 1828022 | A | 9/2006 |
| CN | 1854525 | A | 11/2006 |
| CN | 1963214 | A | 5/2007 |
| CN | 1995756 | A | 7/2007 |
| CN | 101358592 | A | 2/2009 |
| CN | 101684785 | A | 3/2010 |
| CN | 101761479 | A | 6/2010 |
| CN | 101806302 | A | 8/2010 |
| CN | 101910637 | A | 12/2010 |
| CN | 102076963 | A | 5/2011 |
| CN | 102089525 | A | 6/2011 |
| CN | 102272454 | A | 12/2011 |
| CN | 102400915 | A | 4/2012 |
| CN | 102422024 | A | 4/2012 |
| CN | 102449314 | A | 5/2012 |
| CN | 102705234 | A | 10/2012 |
| CN | 102762866 | A | 10/2012 |
| CN | 202926640 | U | 5/2013 |
| CN | 103502644 | A | 1/2014 |
| CN | 103671125 | A | 3/2014 |
| CN | 203962320 | U | 11/2014 |
| CN | 204041454 | U | 12/2014 |
| CN | 104838143 | A | 8/2015 |
| CN | 105317678 | A | 2/2016 |
| CN | 205533207 | U | 8/2016 |
| CN | 205823629 | U | 12/2016 |
| CN | 205876712 | U | 1/2017 |
| CN | 205876713 | U | 1/2017 |
| CN | 205895597 | U | 1/2017 |
| CN | 207513832 | U | 6/2018 |
| CN | 209621603 | U | 11/2019 |
| CN | 209654225 | U | 11/2019 |
| CN | 209781195 | U | 12/2019 |
| DE | 3917656 | C2 | 11/1995 |
| DE | 102011001394 | A1 | 9/2012 |
| EP | 0747598 | A2 | 12/1996 |
| EP | 0822335 | A2 | 2/1998 |
| EP | 1067289 | A2 | 1/2001 |
| EP | 1087142 | A2 | 3/2001 |
| EP | 1182353 | A1 | 2/2002 |
| EP | 1241417 | A1 | 9/2002 |
| EP | 1371851 | A2 | 12/2003 |
| EP | 1382854 | A2 | 1/2004 |
| EP | 2151577 | A1 | 2/2010 |
| EP | 1927755 | A3 | 11/2013 |
| FR | 2764347 | A1 | 12/1998 |
| GB | 2107829 | A | 5/1983 |
| JP | S58214689 | A | 12/1983 |
| JP | S60259794 | A | 12/1985 |
| JP | S62220789 | A | 9/1987 |
| JP | S6385277 | A | 4/1988 |
| JP | S63205482 | A | 8/1988 |
| JP | H01178789 | A | 7/1989 |
| JP | H0281982 | A | 3/1990 |
| JP | H02153282 | A | 6/1990 |
| JP | H03081588 | A | 4/1991 |
| JP | H03233101 | A | 10/1991 |
| JP | H04121478 | A | 4/1992 |
| JP | H04272490 | A | 9/1992 |
| JP | H0610601 | A | 1/1994 |
| JP | H0726618 | B2 | 3/1995 |
| JP | H07293456 | A | 11/1995 |
| JP | H08247053 | A | 9/1996 |
| JP | H8320079 | A | 12/1996 |
| JP | H08334094 | A | 12/1996 |

(56) References Cited

FOREIGN PATENT DOCUMENTS

| | | | |
|---|---|---|---|
| JP | H09177689 | A | 7/1997 |
| JP | H11107950 | A | 4/1999 |
| JP | H11166490 | A | 6/1999 |
| JP | 2951752 | B2 | 9/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 3141949 | B2 | 3/2001 |
| JP | 2002202074 | A | 7/2002 |
| JP | 2003074481 | A | 3/2003 |
| JP | 2003074482 | A | 3/2003 |
| JP | 2003106258 | A | 4/2003 |
| JP | 2003214365 | A | 7/2003 |
| JP | 2003227479 | A | 8/2003 |
| JP | 2004239070 | A | 8/2004 |
| JP | 2005264827 | A | 9/2005 |
| JP | 2006083754 | A | 3/2006 |
| JP | 2006183474 | A | 7/2006 |
| JP | 2007154761 | A | 6/2007 |
| JP | 2007228683 | A | 9/2007 |
| JP | 2008248775 | A | 10/2008 |
| JP | 2013104305 | A | 5/2013 |
| JP | 2013167215 | A | 8/2013 |
| KR | 1019870000015 | | 5/1985 |
| KR | 870000015 | B1 | 1/1987 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 20120008045 | A | 1/2012 |
| KR | 101192642 | B1 | 10/2012 |
| KR | 20120115581 | A | 10/2012 |
| KR | 20130094646 | A | 8/2013 |
| WO | WO-9515025 | A1 | 6/1995 |
| WO | WO-0073659 | A1 | 12/2000 |
| WO | WO-2007046810 | A2 | 4/2007 |
| WO | WO-2008060525 | A1 | 5/2008 |
| WO | WO-2009017741 | A1 | 2/2009 |
| WO | WO-2009155099 | A2 | 12/2009 |
| WO | WO-2010118140 | A2 | 10/2010 |
| WO | WO-2011106422 | A2 | 9/2011 |
| WO | WO-2012114455 | A1 | 8/2012 |
| WO | WO-2017071641 | A1 | 5/2017 |

OTHER PUBLICATIONS

Office Action regarding European Patent Application No. 11747996.4, dated Nov. 5, 2019.
Notice of Allowance regarding U.S. Appl. No. 15/186,151, dated Nov. 14, 2019.
Office Action regarding Indian Patent Application No. 2043/MUMNP/2011, dated Nov. 27, 2019.
Office Action regarding Chinese Patent Application No. 201811480347.5, dated Jan. 10, 2020. Translation provided by Unitalen Attorneys at Law.
Office Action regarding Chinese Patent Application No. 201811541653.5, dated Jan. 10, 2020. Translation provided by Unitalen Attorneys at Law.
Office Action regarding European Patent Application No. 11747996.4, dated Jan. 14, 2020.
Office Action regarding U.S. Appl. No. 15/881,016, dated Jan. 23, 2020.
Office Action regarding U.S. Appl. No. 15/682,599, dated Jan. 24, 2020.
Office Action regarding U.S. Appl. No. 15/831,423, dated Jan. 31, 2020.
U.S. Appl. No. 16/154,406, filed Oct. 8, 2018, Roy J. Doepker et al.
U.S. Appl. No. 16/154,844, filed Oct. 9, 2018, Jeffrey Lee Berning et al.
U.S. Appl. No. 16/177,902, filed Nov. 1, 2018, Michael M. Perevozchikov et al.
Luckevich, Mark, "MEMS microvalves: the new valve world." Valve World, May 2007, pp. 79-83.
Non-Final Office Action for U.S. Appl. No. 11/522,250, dated Aug. 1, 2007.
Extended European Search Report regarding Application No. EP07254962, dated Mar. 12, 2008.
Notification of the First Office Action received from the Chinese Patent Office, dated Mar. 6, 2009 regarding Application No. 200710153687.2, translated by CCPIT Patent and Trademark Law Office.
Non-Final Office Action for U.S. Appl. No. 12/103,265, dated May 27, 2009.
U.S. Office Action regarding U.S. Appl. No. 11/645,288, dated Nov. 30, 2009.
Non-Final Office Action for U.S. Appl. No. 12/103,265, dated Dec. 17, 2009.
Notice of Grounds for Rejection regarding Korean Patent Application No. 10-2007-0093478, dated Feb. 25, 2010. Translation provided by Y.S. Chang & Associates.
Final Office Action for U.S. Appl. No. 12/103,265, dated Jun. 15, 2010.
First China Office Action regarding Application No. 200710160038.5, dated Jul. 8, 2010. Translation provided by Unitalen Attorneys at Law.
Final Preliminary Notice of Grounds for Rejection regarding Korean Patent Application No. 10-2007-0093478, dated Aug. 31, 2010. Translation provided by Y.S. Chang & Associates.
Advisory Action for U.S. Appl. No. 12/103,265, dated Sep. 17, 2010.
International Search Report regarding Application No. PCT/US2010/030248, dated Nov. 26, 2010.
Written Opinion of the International Searching Authority regarding Application No. PCT/US2010/030248, dated Nov. 26, 2010.
International Search Report regarding Application No. PCT/US2011/025921, dated Oct. 7, 2011.
Written Opinion of the International Search Authority regarding Application No. PCT/US2011/025921, dated Oct. 7, 2011.
China Office Action regarding Application No. 200710160038.5, dated Jan. 31, 2012. Translation provided by Unitalen Attorneys at Law.
First Office Action regarding Chinese Patent Application No. 201010224582.3, dated Apr. 17, 2012. English translation provided by Unitalen Attorneys at Law.
First Examination Report regarding Indian Patent Application No. 1071/KOL/2007, dated Apr. 27, 2012.
Non-Final Office Action for U.S. Appl. No. 13/0365,529, dated Aug. 22, 2012.
U.S. Office Action regarding U.S. Appl. No. 13/181,065, dated Nov. 9, 2012.
International Search Report regarding Application No. PCT/US2013/051678, dated Oct. 21, 2013.
Written Opinion of the International Searching Authority regarding Application No. PCT/US2013/051678, dated Oct. 21, 2013.
China Office Action regarding Application No. 201080020243.1, dated Nov. 5, 2013. Translation provided by Unitalen Attorneys at Law.
International Search Report regarding Application No. PCT/US2013/069456, dated Feb. 18, 2014.
Written Opinion of the International Searching Authority regarding Application No. PCT/US2013/069456, dated Feb. 18, 2014.
International Search Report regarding Application No. PCT/US2013/069462, dated Feb. 21, 2014.
Written Opinion of the International Searching Authority regarding Application No. PCT/US2013/069462, dated Feb. 21, 2014.
International Search Report regarding Application No. PCT/US2013/070992, dated Feb. 25, 2014.
Written Opinion of the International Searching Authority regarding Application No. PCT/US2013/070992, dated Feb. 25, 2014.
International Search Report regarding Application No. PCT/US2013/070981, dated Mar. 4, 2014.
Written Opinion of the International Searching Authority regarding Application No. PCT/US2013/070981, dated Mar. 4, 2014.

(56) References Cited

OTHER PUBLICATIONS

Second Office Action regarding China Application No. 201180010366.1, dated Dec. 31, 2014. Translation provided by Unitalen Attorneys at Law.
Office Action regarding U.S. Appl. No. 14/081,390, dated Mar. 27, 2015.
Search Report regarding European Patent Application No. 10762374.6-1608 / 2417356 PCT/US2010030248, dated Jun. 16, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding U.S. Appl. No. 14/073,293, dated Sep. 25, 2015.
Restriction Requirement regarding U.S. Appl. No. 14/060,102, dated Oct. 7, 2015.
International Search Report regarding International Application No. PCT/US2015/042479, dated Oct. 23, 2015.
Written Opinion of the International Searching Authority regarding International Application No. PCT/US2015/042479, dated Oct. 23, 2015.
Office Action regarding Chinese Patent Application No. 201410461048.2, dated Nov. 30, 2015. Translation provided by Unitalen Attorneys at Law.
Interview Summary regarding U.S. Appl. No. 14/060,240, dated Dec. 1, 2015.
Office Action regarding U.S. Appl. No. 14/073,293, dated Jan. 29, 2016.
Office Action regarding Chinese Patent Application No. 201410460792.0, dated Feb. 25, 2016. Translation provided by Unitalen Attorneys at Law.
Restriction Requirement regarding U.S. Appl. No. 14/060,102, dated Mar. 16, 2016.
First Office Action regarding Chinese Application No. 201380059666.8, dated Apr. 5, 2016. Translation provided by Unitalen Attorneys at Law.
First Office Action regarding Chinese Application No. 201380062614.6, dated Apr. 5, 2016. Translation provided by Unitalen Attorneys at Law.
Advisory Action regarding U.S. Appl. No. 14/073,293, dated Apr. 18, 2016.
Office Action regarding Chinese Patent Application No. 201380062657.4, dated May 4, 2016. Translation provided by Unitalen Attorneys at Law.
Office Action regarding Chinese Patent Application No. 201380059963.2, dated May 10, 2016. Translation provided by Unitalen Attorneys at Law.
Office Action regarding U.S. Appl. No. 14/060,102, dated Jun. 14, 2016.
Office Action regarding U.S. Appl. No. 14/846,877, dated Jul. 15, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.
Office Action regarding U.S. Appl. No. 14/294,458, dated Aug. 19, 2016.
Office Action regarding Chinese Patent Application No. 201410460792.0, dated Oct. 21, 2016. Translation provided by Unitalen Attorneys at Law.
Search Report regarding European Patent Application No. 11747996.4, dated Nov. 7, 2016.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.
Office Action regarding U.S. Appl. No. 14/663,073, dated Apr. 11, 2017.
Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Advisory Action regarding U.S. Appl. No. 14/294,458, dated Jun. 9, 2017.
Office Action regarding Chinese Patent Application No. 201610703191.7, dated Jun. 13, 2017. Translation provided by Unitalen Attorneys at Law.
Office Action regarding Indian Patent Application No. 2043/MUMNP/2011, dated Jul. 28, 2017.
Restriction Requirement regarding U.S. Appl. No. 14/809,786, dated Aug. 16, 2017.
Office Action regarding U.S. Appl. No. 14/294,458, dated Sep. 21, 2017.
Office Action regarding U.S. Appl. No. 14/757,407, dated Oct. 13, 2017.
Office Action regarding Chinese Patent Application No. 201610158216.X, dated Oct. 30, 2017. Translation provided by Unitalen Attorneys at Law.
Office Action regarding Chinese Patent Application No. 201410460792.0, dated Nov. 1, 2017. Translation provided by Unitalen Attorneys at Law.
Office Action regarding Chinese Patent Application No. 201610512702.7, dated Dec. 20, 2017. Partial translation provided by Unitalen Attorneys at Law.
International Search Report regarding International Application No. PCT/US2017/050525, dated Dec. 28, 2017.
Written Opinion of the International Searching Authority regarding International Application No. PCT/US2017/050525, dated Dec. 28, 2017.
Office Action regarding Chinese Patent Application No. 201610499158.7, dated Jan. 9, 2018. Translation provided by Unitalen Attorneys at Law.
Non-Final Office Action for U.S. Appl. No. 14/809,786, dated Jan. 11, 2018.
Office Action regarding Chinese Patent Application No. 201580029636.1, dated Jan. 17, 2018. Translation provided by Unitalen Attorneys at Law.
Office Action regarding Chinese Patent Application No. 201580041209.5, dated Jan. 17, 2018. Translation provided by Unitalen Attorneys at Law.
Office Action regarding U.S. Appl. No. 15/646,654, dated Feb. 9, 2018.
Office Action regarding U.S. Appl. No. 15/651,471 dated Feb. 23, 2018.
Office Action regarding Indian Patent Application No. 1907/MUMNP/2012, dated Feb. 26, 2018.
Election Requirement regarding U.S. Appl. No. 15/186,092, dated Apr. 3, 2018.
Election Requirement regarding U.S. Appl. No. 15/784,458, dated Apr. 5, 2018.

(56) References Cited

OTHER PUBLICATIONS

Office Action regarding Korean Patent Application No. 10-2016-7034539, dated Apr. 11, 2018. Translation provided by Y.S. Chang & Associates.
Office Action regarding U.S. Appl. No. 15/186,151, dated May 3, 2018.
Office Action regarding Chinese Patent Application No. 201610930347.5, dated May 14, 2018. Translation provided by Unitalen Attorneys at Law.
Election/Restriction Requirement regarding U.S. Appl. No. 15/187,225, dated May 15, 2018.
Notice of Allowance regarding U.S. Appl. No. 14/757,407, dated May 24, 2018.
Office Action regarding Chinese Patent Application No. 201610158216.X, dated Jun. 13, 2018. Translation provided by Unitalen Attorneys at Law.
Office Action regarding European Patent Application No. 13859308.2, dated Jun. 22, 2018.
Office Action regarding U.S. Appl. No. 15/186,092, dated Jun. 29, 2018.
Notice of Allowance regarding U.S. Appl. No. 15/646,654, dated Jul. 11, 2018.
Notice of Allowance regarding U.S. Appl. No. 15/651,471, dated Jul. 11, 2018.
Office Action regarding U.S. Appl. No. 15/784,540, dated Jul. 17, 2018.
Office Action regarding U.S. Appl. No. 15/784,458, dated Jul. 19, 2018.
Election/Restriction Requirement regarding U.S. Appl. No. 15/587,735, dated Jul. 23, 2018.
Office Action regarding Chinese Patent Application No. 201610499158.7, dated Aug. 1, 2018. Translation provided by Unitalen Attorneys at Law.
Applicant-Initiated Interview Summary regarding U.S. Appl. No. 15/186,092, dated Aug. 14, 2018.
Office Action regarding U.S. Appl. No. 15/187,225, dated Aug. 27, 2018.
Office Action regarding Chinese Patent Application No. 201710795228.8, dated Sep. 5, 2018. Translation provided by Unitalen Attorneys at Law.
Office Action regarding Korean Patent Application No. 10-2016-7034539, dated Sep. 6, 2018. Translation provided by Y.S. Chang & Associates.
Office Action regarding Indian Patent Application No. 1307/MUMNP/2015, dated Sep. 12, 2018.
Office Action regarding Chinese Patent Application No. 201580029636.1, dated Oct. 8, 2018. Translation provided by Unitalen Attorneys at Law.
Office Action regarding U.S. Appl. No. 15/587,735, dated Oct. 9, 2018.
Office Action regarding U.S. Appl. No. 15/186,151, dated Nov. 1, 2018.
Office Action regarding Korean Patent Application No. 10-2017-7033995, dated Nov. 29, 2018. Translation provided by KS KORYO International IP Law Firm.
Notice of Allowance regarding U.S. Appl. No. 15/186,151, dated Jul. 25, 2019.
Office Action regarding Chinese Patent Application No. 201610499158.7, dated Aug. 1, 2019. Translation provided by Unitalen Attorneys at Law.
Office Action regarding Chinese Patent Application No. 201811168307.7, dated Aug. 12, 2019. Translation provided by Unitalen Attorneys at Law.
Restriction Requirement regarding U.S. Appl. No. 15/682,599, dated Aug. 14, 2019.
Notice of Allowance regarding U.S. Appl. No. 15/587,735, dated Aug. 23, 2019.
International Search Report regarding International Application No. PCT/US2019/032718, dated Aug. 23, 2019.
Written Opinion of the International Searching Authority regarding International Application No. PCT/US2019/032718, dated Aug. 23, 2019.
Office Action regarding Chinese Patent Application No. 201780055443.2, dated Sep. 2, 2019. Translation provided by Unitalen Attorneys at Law.
Office Action regarding U.S. Appl. No. 15/692,844, dated Sep. 20, 2019.
Notice of Allowance regarding U.S. Appl. No. 15/692,844, dated Feb. 20, 2020.
Office Action regarding European Patent Application No. 13859308.2, dated Mar. 4, 2020.
Office Action regarding Chinese Patent Application No. 201811168307.7, dated Mar. 27, 2020. Translation provided by Unitalen Attorneys at Law.
Office Action regarding Korean Patent Application No. 10-2018-0159231, dated Apr. 7, 2020. Translation provided by KS KORYO International IP Law Firm.
Office Action regarding Chinese Patent Application No. 201780055443.2, dated Apr. 14, 2020. Translation provided by Unitalen Attorneys at Law.
Notice of Allowance regarding U.S. Appl. No. 15/682,599, dated Apr. 22, 2020.
Notice of Allowance regarding U.S. Appl. No. 15/831,423, dated May 20, 2020.
Notice of Allowance regarding U.S. Appl. No. 15/692,844, dated Jun. 4, 2020.
Office Action regarding U.S. Appl. No. 16/154,406, dated Jun. 29, 2020.
Restriction Requirement regarding U.S. Appl. No. 16/154,844, dated Jul. 2, 2020.
Office Action regarding Chinese Patent Application No. 201811480347.5, dated Jul. 21, 2020. Translation provided by Unitalen Attorneys at Law.
Office Action regarding U.S. Appl. No. 15/881,016, dated Jul. 21, 2020.
Office Action regarding U.S. Appl. No. 16/177,902, dated Jul. 23, 2020.
Office Action regarding Chinese Patent Application No. 201180010366.1, dated Jun. 4, 2014. Translation provided by Unitalen Attorneys at Law.
Office Action regarding Chinese Patent Application No. 201610516097.0, dated Jun. 27, 2017. Translation provided by Unitalen Attorneys at Law.
Notice of Allowance regarding U.S. Appl. No. 15/186,092, dated Dec. 20, 2018.
Office Action regarding Indian Patent Application No. 1306/MUMNP/2015, dated Dec. 31, 2018.
Notice of Allowance regarding U.S. Appl. No. 15/187,225, dated Jan. 3, 2019.
Office Action regarding Chinese Patent Application No. 201610499158.7, dated Feb. 1, 2019. Translation provided by Unitalen Attorneys at Law.
Notice of Allowance regarding U.S. Appl. No. 15/784,458, dated Feb. 7, 2019.
Notice of Allowance regarding U.S. Appl. No. 15/784,540, dated Feb. 7, 2019.
Search Report regarding European Patent Application No. 18198310.7, dated Feb. 27, 2019.
Notice of Allowance regarding U.S. Appl. No. 15/186,151, dated Mar. 19, 2019.
Notice of Allowance regarding U.S. Appl. No. 15/186,092, dated Apr. 19, 2019.
Office Action regarding Chinese Patent Application No. 201710795228.8, dated Apr. 29, 2019. Translation provided by Unitalen Attorneys at Law.
Notice of Allowance regarding U.S. Appl. No. 15/187,225, dated May 2, 2019.
Office Action regarding U.S. Appl. No. 15/587,735, dated May 17, 2019.
Office Action regarding Chinese Patent Application No. 201811011292.3, dated Jun. 21, 2019. Translation provided by Unitalen Attorneys at Law.

(56) References Cited

OTHER PUBLICATIONS

Office Action regarding European Patent Application No. 11747996.
4, dated Jun. 26, 2019.

* cited by examiner

VARIABLE VOLUME RATIO COMPRESSOR

CROSS-REFERENCE TO RELATED APPLICATIONS

This application claims the benefit of U.S. Provisional Application No. 62/567,277, filed on Oct. 3, 2017. The entire disclosure of the above application is incorporated herein by reference.

FIELD

The present disclosure relates to a variable volume ratio compressor.

BACKGROUND

This section provides background information related to the present disclosure and is not necessarily prior art.

Compressors are used in a variety of industrial, commercial and residential applications to circulate a working fluid within a climate-control system (e.g., a refrigeration system, an air conditioning system, a heat-pump system, a chiller system, etc.) to provide a desired cooling and/or heating effect. A typical climate-control system may include a fluid circuit having an outdoor heat exchanger, an indoor heat exchanger, an expansion device disposed between the indoor and outdoor heat exchangers, and a compressor circulating a working fluid (e.g., refrigerant or carbon dioxide) between the indoor and outdoor heat exchangers. Efficient and reliable operation of the compressor is desirable to ensure that the climate-control system in which the compressor is installed is capable of effectively and efficiently providing a cooling and/or heating effect on demand.

SUMMARY

This section provides a general summary of the disclosure, and is not a comprehensive disclosure of its full scope or all of its features.

The present disclosure provides a compressor that may include a shell assembly, a non-orbiting scroll, an orbiting scroll, and variable-volume-ratio valve assembly. The shell assembly may define a discharge chamber. The non-orbiting scroll may be disposed within the discharge chamber and may include a first end plate and a first spiral wrap extending from the first end plate. The orbiting scroll may be disposed within the discharge chamber and may include a second end plate and a second spiral wrap extending from the second end plate. The first and second spiral wraps mesh with each other to define a plurality of fluid pockets therebetween. The fluid pockets are movable among a radially outermost position, a radially intermediate position, and a radially innermost position. The second end plate may include a variable-volume-ratio port extending therethrough and selectively communicating with one of the fluid pockets at the radially intermediate position. The variable-volume-ratio valve assembly may be mounted to the orbiting scroll and may include a valve member that is movable relative to the orbiting scroll between an open position allowing communication between the variable-volume-ratio port and the discharge chamber and a closed position restricting communication between the variable-volume-ratio port and the discharge chamber.

In some configurations of the compressor of the above paragraph, when the valve member is in the open position, fluid flows from the variable-volume-ratio port to the discharge chamber without flowing back into any of the fluid pockets.

In some configurations of the compressor of either of the above paragraphs, the first end plate of the non-orbiting scroll includes a discharge passage in communication with the discharge chamber and one of the fluid pockets at the radially innermost position. The variable-volume-ratio port is disposed radially outward relative to the discharge passage.

In some configurations of the compressor of any one or more of the above paragraphs, when the valve member is in the open position, fluid flows from the variable-volume-ratio port to the discharge chamber without flowing through the discharge passage in the non-orbiting scroll.

In some configurations of the compressor of any one or more of the above paragraphs, the second end plate includes an annular hub extending from a side of the second end plate opposite the second spiral wrap. The annular hub may define a cavity in which the variable-volume-ratio valve assembly is at least partially disposed.

In some configurations of the compressor of any one or more of the above paragraphs, the compressor includes a driveshaft engaging the annular hub and driving the orbiting scroll.

In some configurations of the compressor of any one or more of the above paragraphs, the driveshaft includes a crank pin disposed within the cavity.

In some configurations of the compressor of any one or more of the above paragraphs, the compressor includes a bearing disposed within the cavity and receiving the crank pin. The bearing may at least partially define a flow path extending from the variable-volume-ratio port to the discharge chamber.

In some configurations of the compressor of any one or more of the above paragraphs, the compressor includes a bearing disposed within the cavity and receiving the crank pin. The annular hub includes a flow passage extending therethrough. The flow passage may be disposed radially outward relative to the bearing and at least partially defines a flow path extending from the variable-volume-ratio port to the discharge chamber.

In some configurations of the compressor of any one or more of the above paragraphs, the annular hub is a two-piece hub including a first annular member and a second annular member. The second annular member may be at least partially received within the first annular member and may receive the bearing.

In some configurations of the compressor of any one or more of the above paragraphs, the variable-volume-ratio valve assembly includes a retainer disposed within the cavity and fixedly mounted to the second end plate.

In some configurations of the compressor of any one or more of the above paragraphs, the valve member is a reed valve that is sandwiched between the retainer and the second end plate. The reed valve may bend between the open and closed positions.

In some configurations of the compressor of any one or more of the above paragraphs, the second end plate includes another variable-volume-ratio port. The valve member may selectively open and close the variable-volume-ratio ports. The valve member may be fixedly attached to the second end plate at a location radially between the variable-volume-ratio ports.

In some configurations of the compressor of any one or more of the above paragraphs, the second end plate includes a recess disposed between and in communication with the variable-volume-ratio port and the cavity. The valve member may be disposed within the recess and may be movable therein between the open and closed positions.

In some configurations of the compressor of any one or more of the above paragraphs, the variable-volume-ratio valve assembly includes a spring disposed at least partially within the recess and between the valve member and the retainer. The spring may bias the valve member toward the closed position.

In some configurations of the compressor of any one or more of the above paragraphs, the valve member is a disc-shaped member having a flow passage formed in its periphery.

In some configurations of the compressor of any one or more of the above paragraphs, the second end plate includes an additional variable-volume-ratio port. The variable-volume-ratio valve assembly may include another spring and another valve member movably received within another recess that is in communication with the cavity and the additional variable-volume-ratio port.

In some configurations of the compressor of any one or more of the above paragraphs, the second end plate includes an annular hub extending from a side of the second end plate opposite the second spiral wrap. The annular hub may define a cavity that receives a crank pin of a driveshaft. The annular hub may be a two-piece hub including a first annular member and a second annular member. The second annular member may be partially received within the first annular member and may receive the crank pin. The variable-volume-ratio valve assembly may be mounted to the second annular member.

In some configurations of the compressor of any one or more of the above paragraphs, the variable-volume-ratio valve assembly includes a spring disposed between the second annular member and the valve member and biasing the valve member toward the closed position.

In some configurations of the compressor of any one or more of the above paragraphs, the valve member is a disc-shaped member having a flow passage formed in its periphery.

In some configurations of the compressor of any one or more of the above paragraphs, the valve member is disposed radially between the first and second annular members and extends partially around the crank pin of the driveshaft.

In some configurations of the compressor of any one or more of the above paragraphs, the variable-volume-ratio port extends through a portion of the first annular member.

In some configurations of the compressor of any one or more of the above paragraphs, the valve member contacts an inner diametrical surface of the first annular member when the valve member is in the closed position.

In some configurations of the compressor of any one or more of the above paragraphs, a portion of the valve member moves inward away from the inner diametrical surface of the first annular member when the valve member moves from the closed position to the open position.

In some configurations of the compressor of any one or more of the above paragraphs, the orbiting scroll includes a first portion and a second portion attached to the first portion by a plurality of fasteners. The first portion may include the second spiral wrap and a portion of the second end plate. The second portion may include another portion of the second end plate and an annular hub that receives a crank pin of a driveshaft.

In some configurations of the compressor of any one or more of the above paragraphs, the annular hub includes a flow passage in communication with the variable-volume-ratio port and the discharge chamber.

In some configurations of the compressor of any one or more of the above paragraphs, the variable-volume-ratio valve assembly includes a spring disposed between the valve member and the second portion of the orbiting scroll. The spring may bias the valve member toward a valve seat defined by the first portion of the orbiting scroll.

In some configurations of the compressor of any one or more of the above paragraphs, the compressor includes a driveshaft having an eccentric recess.

In some configurations of the compressor of any one or more of the above paragraphs, the second end plate includes an annular hub extending from a side of the second end plate opposite the second spiral wrap.

In some configurations of the compressor of any one or more of the above paragraphs, the annular hub defines a cavity in which the variable-volume-ratio valve assembly is at least partially disposed.

In some configurations of the compressor of any one or more of the above paragraphs, the annular hub is received within the eccentric recess of the driveshaft.

In some configurations of the compressor of any one or more of the above paragraphs, the driveshaft includes a flow passage in fluid communication with the cavity.

In some configurations of the compressor of any one or more of the above paragraphs, when the valve member is in the open position, fluid from the variable-volume-ratio port flows into the cavity.

In some configurations of the compressor of any one or more of the above paragraphs, fluid in the cavity may flow into the discharge chamber via the flow passage in the driveshaft.

In some configurations of the compressor of any one or more of the above paragraphs, the flow passage is disposed in a collar portion of the driveshaft.

In some configurations of the compressor of any one or more of the above paragraphs, the collar portion is disposed at an axial end of the driveshaft and defines the eccentric recess.

The present disclosure also provides a compressor that may include a shell assembly, a first scroll, a second scroll, and variable-volume-ratio valve assembly. The shell assembly may define a discharge chamber. The first scroll may be disposed within the discharge chamber and may include a first end plate and a first spiral wrap extending from the first end plate. The first end plate may include a discharge passage in communication with the discharge chamber. The second scroll may be disposed within the discharge chamber and may include a second end plate and a second spiral wrap extending from the second end plate. The first and second spiral wraps mesh with each other to define a plurality of moving fluid pockets therebetween. The second end plate may include a variable-volume-ratio port disposed radially outward relative to the discharge passage and selectively communicating with one of the fluid pockets. The variable-volume-ratio valve assembly may be mounted to the second scroll and may include a valve member that is movable relative to the second scroll between an open position allowing communication between the variable-volume-ratio port and the discharge chamber and a closed position restricting communication between the variable-volume-ratio port and the discharge chamber.

In some configurations of the compressor of the above paragraph, the first scroll is a non-orbiting scroll, and the second scroll is an orbiting scroll.

In some configurations of the compressor of any one or more of the above paragraphs, the second end plate includes an annular hub extending from a side of the second end plate opposite the second spiral wrap. The annular hub may define a cavity in which the variable-volume-ratio valve assembly is at least partially disposed.

In some configurations of the compressor of any one or more of the above paragraphs, the compressor includes a driveshaft engaging the annular hub and driving the orbiting scroll.

In some configurations of the compressor of any one or more of the above paragraphs, the driveshaft includes a crank pin disposed within the cavity.

In some configurations of the compressor of any one or more of the above paragraphs, the compressor includes a bearing disposed within the cavity and receiving the crank pin. The bearing may at least partially define a flow path extending from the variable-volume-ratio port to the discharge chamber.

In some configurations of the compressor of any one or more of the above paragraphs, the compressor includes a bearing disposed within the cavity and receiving the crank pin. The annular hub includes a flow passage extending therethrough. The flow passage may be disposed radially outward relative to the bearing and at least partially defines a flow path extending from the variable-volume-ratio port to the discharge chamber.

In some configurations of the compressor of any one or more of the above paragraphs, the annular hub is a two-piece hub including a first annular member and a second annular member. The second annular member may be at least partially received within the first annular member and may receive the bearing.

In some configurations of the compressor of any one or more of the above paragraphs, the variable-volume-ratio valve assembly includes a retainer disposed within the cavity and fixedly mounted to the second end plate.

In some configurations of the compressor of any one or more of the above paragraphs, the valve member is a reed valve that is sandwiched between the retainer and the second end plate. The reed valve may bend between the open and closed positions.

In some configurations of the compressor of any one or more of the above paragraphs, the second end plate includes another variable-volume-ratio port. The valve member may selectively open and close the variable-volume-ratio ports. The valve member may be fixedly attached to the second end plate at a location radially between the variable-volume-ratio ports.

In some configurations of the compressor of any one or more of the above paragraphs, the second end plate includes a recess disposed between and in communication with the variable-volume-ratio port and the cavity. The valve member may be disposed within the recess and may be movable therein between the open and closed positions.

In some configurations of the compressor of any one or more of the above paragraphs, the variable-volume-ratio valve assembly includes a spring disposed at least partially within the recess and between the valve member and the retainer. The spring may bias the valve member toward the closed position.

In some configurations of the compressor of any one or more of the above paragraphs, the valve member is a disc-shaped member having a flow passage formed in its periphery.

In some configurations of the compressor of any one or more of the above paragraphs, the second end plate includes an additional variable-volume-ratio port. The variable-volume-ratio valve assembly may include another spring and another valve member movably received within another recess that is in communication with the cavity and the additional variable-volume-ratio port.

In some configurations of the compressor of any one or more of the above paragraphs, the second end plate includes an annular hub extending from a side of the second end plate opposite the second spiral wrap. The annular hub may define a cavity that receives a crank pin of a driveshaft. The annular hub may be a two-piece hub including a first annular member and a second annular member. The second annular member may be partially received within the first annular member and may receive the crank pin. The variable-volume-ratio valve assembly may be mounted to the second annular member.

In some configurations of the compressor of any one or more of the above paragraphs, the variable-volume-ratio valve assembly includes a spring disposed between the second annular member and the valve member and biasing the valve member toward the closed position.

In some configurations of the compressor of any one or more of the above paragraphs, the valve member is a disc-shaped member having a flow passage formed in its periphery.

In some configurations of the compressor of any one or more of the above paragraphs, the valve member is disposed radially between the first and second annular members and extends partially around the crank pin of the driveshaft.

In some configurations of the compressor of any one or more of the above paragraphs, the variable-volume-ratio port extends through a portion of the first annular member.

In some configurations of the compressor of any one or more of the above paragraphs, the valve member contacts an inner diametrical surface of the first annular member when the valve member is in the closed position.

In some configurations of the compressor of any one or more of the above paragraphs, a portion of the valve member moves inward away from the inner diametrical surface of the first annular member when the valve member moves from the closed position to the open position.

In some configurations of the compressor of any one or more of the above paragraphs, the second scroll includes a first portion and a second portion attached to the first portion by a plurality of fasteners. The first portion may include the second spiral wrap and a portion of the second end plate. The second portion may include another portion of the second end plate.

In some configurations of the compressor of any one or more of the above paragraphs, the second portion includes an annular hub that receives a crank pin of a driveshaft.

In some configurations of the compressor of any one or more of the above paragraphs, the annular hub includes a flow passage in communication with the variable-volume-ratio port and the discharge chamber.

In some configurations of the compressor of any one or more of the above paragraphs, the variable-volume-ratio valve assembly includes a spring disposed between the valve member and the second portion of the second scroll. The spring may bias the valve member toward a valve seat defined by the first portion of the second scroll.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
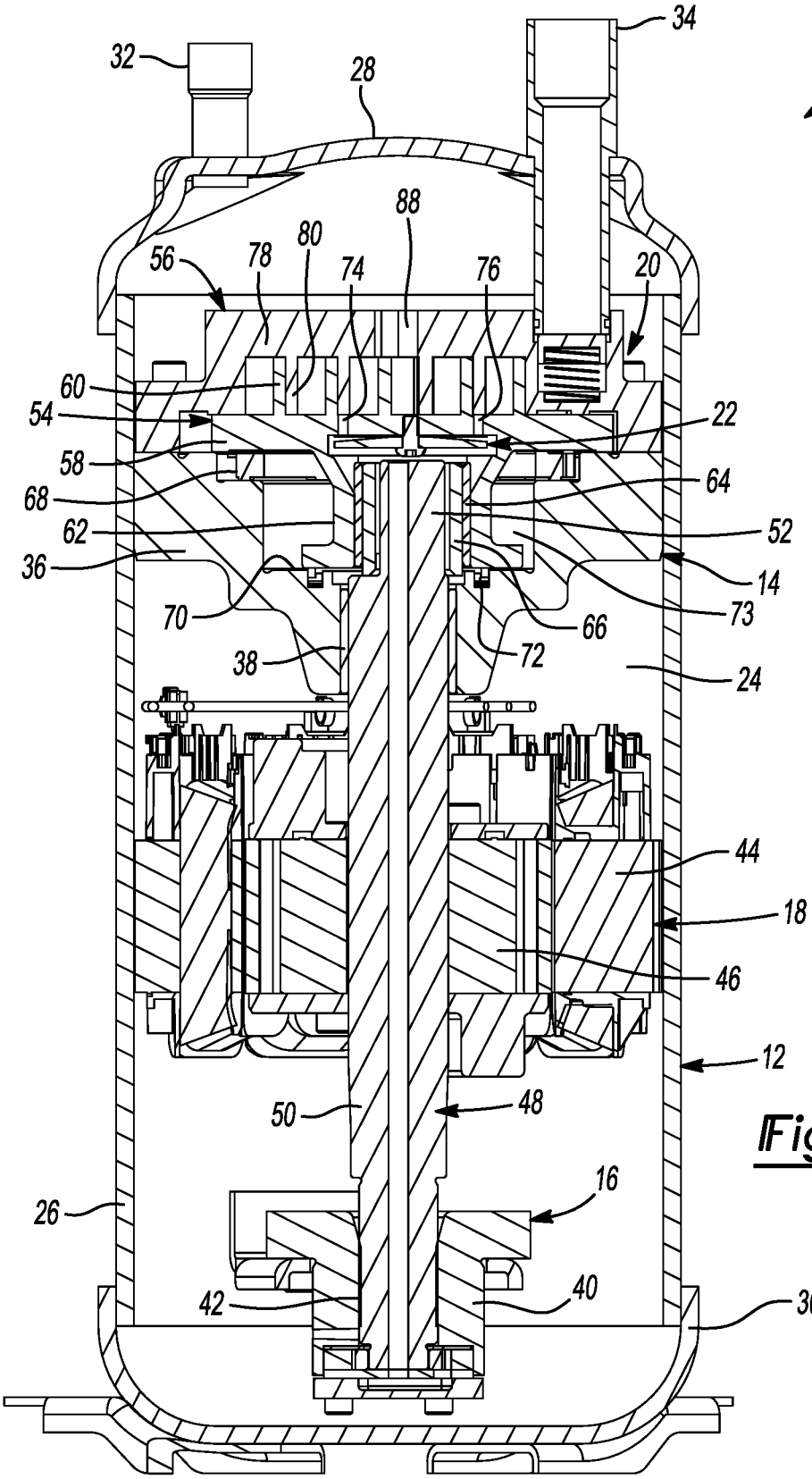
FIG. 1 is a cross-sectional view of a compressor having a variable-volume-ratio valve assembly according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-4, a compressor 10 is provided. The compressor 10 may be a high-side scroll compressor including a hermetic shell assembly 12, a first and second bearing assemblies 14, 16, a motor assembly 18, a compression mechanism 20, and a variable-volume-ratio (VVR) valve assembly 22. As described in more detail below, the VVR valve assembly 22 is operable to prevent the compression mechanism 20 from over-compressing working fluid.

The shell assembly 12 may define a high-pressure discharge chamber 24 and may include a cylindrical shell 26, an end cap 28 at an upper end thereof, and a base 30 at a lower end thereof. A discharge fitting 32 may be attached to the shell assembly 12 (e.g., at the end cap 28) and extend through a first opening in the shell assembly 12 to allow working fluid in the discharge chamber 24 to exit the compressor 10. An inlet fitting 34 may be attached to the shell assembly 12 (e.g., at the end cap 28) and extend through a second opening in the shell assembly 12. The inlet fitting 34 may extend through a portion of the discharge chamber 24 and is fluidly coupled to a suction inlet of the compression mechanism 20. In this manner, the inlet fitting 34 provides low-pressure (suction-pressure) working fluid to the compression mechanism 20 while fluidly isolating the suction-pressure working fluid therein from the high-pressure (i.e., discharge-pressure) working fluid in the discharge chamber 24.

The first and second bearing assemblies 14, 16 may be disposed entirely within the discharge chamber 24. The first bearing assembly 14 may include a first bearing housing 36 and a first bearing 38. The first bearing housing 36 may be fixed to the shell assembly 12. The first bearing housing 36 houses the first bearing 38 and axially supports the compression mechanism 20. The second bearing assembly 16 may include a second bearing housing 40 and a second bearing 42. The second bearing housing 40 is fixed to the shell assembly 12 and supports the second bearing 42.

The motor assembly 18 may be disposed entirely within the discharge chamber 24 and may include a motor stator 44, a rotor 46, and a driveshaft 48. The stator 44 may be fixedly attached (e.g., by press fit) to the shell 26. The rotor 46 may be press fit on the driveshaft 48 and may transmit rotational power to the driveshaft 48. The driveshaft 48 may include a main body 50 and an eccentric crank pin 52 extending from an end of the main body 50. The main body 50 is received in the first and second bearings 38, 42 and is rotatably supported by the first and second bearing assemblies 14, 16. Therefore, the first and second bearings 38, 42 define a rotational axis of the driveshaft 48. The crank pin 52 may engage the compression mechanism 20.

The compression mechanism 20 may be disposed entirely within the discharge chamber 24 and may include an orbiting scroll 54 and a non-orbiting scroll 56. The orbiting scroll 54 may include an end plate 58 having a spiral wrap 60 extending therefrom. An annular hub 62 may project downwardly from the end plate 58 and may include a cavity 63 in which a drive bearing 64, a drive bushing 66 and the crank pin 52 may be disposed. The drive bushing 66 may be received within the drive bearing 64. The crank pin 52 may be received within the drive bushing 66. An Oldham coupling 68 may be engaged with the end plate 58 and either the non-orbiting scroll 56 or the first bearing housing 36 to prevent relative rotation between the orbiting and non-orbiting scrolls 54, 56. The annular hub 62 may be axially supported by a thrust surface 70 of the first bearing housing 36. The annular hub 62 may movably engage a seal 72 attached to the first bearing housing 36 to define an intermediate-pressure cavity 73 between the first bearing housing 36 and the orbiting scroll 54.

The end plate 58 of the orbiting scroll 54 may include a first VVR port 74 and a second VVR port 76. The first and second VVR ports 74, 76 may extend through the end plate 58 and are in selective fluid communication with the cavity 63 formed by the annular hub 62. In some configurations, the end plate 58 may include a plurality of first VVR ports 74 and a plurality of second VVR ports 76. The VVR valve assembly 22 may be disposed within the cavity 63 and may be mounted to the end plate 58. As will be described in more detail below, the VVR valve assembly 22 is operable to selectively allow and restrict communication between the first and second VVR ports 74, 76 and the cavity 63. The cavity 63 is in communication with the discharge chamber 24 via gaps between the hub 62 and the drive bearing 64, between the drive bearing 64 and drive bushing 66, and/or between the drive bushing 66 and the crank pin 52. In some configurations, cavity 63 is in communication with the discharge chamber 24 via flow passages formed in any one or more of the hub 62, drive bearing 64, or drive bushing 66, for example. Therefore, the VVR valve assembly 22 is operable to selectively allow and restrict communication between the first and second VVR ports 74, 76 and the discharge chamber 24.

Figure 2:
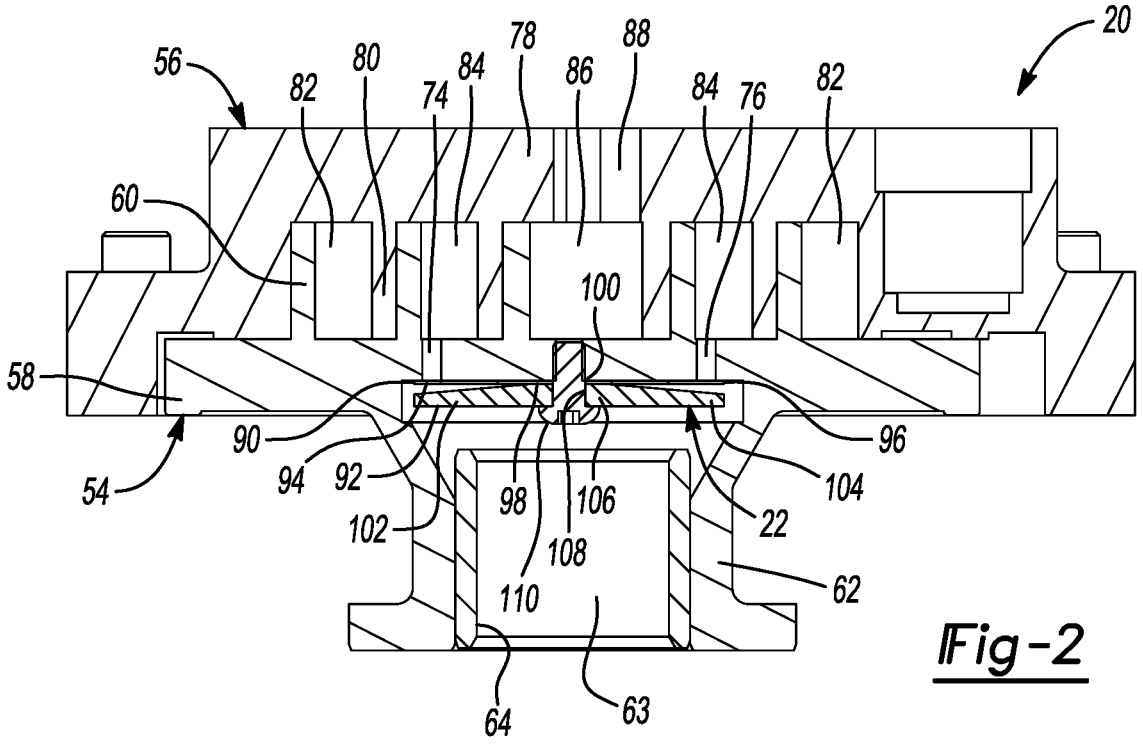
FIG. 2 is a cross-sectional view of a compression mechanism and the variable-volume-ratio valve assembly of the compressor of FIG. 1 with a valve member in a closed position.
Figure 3:
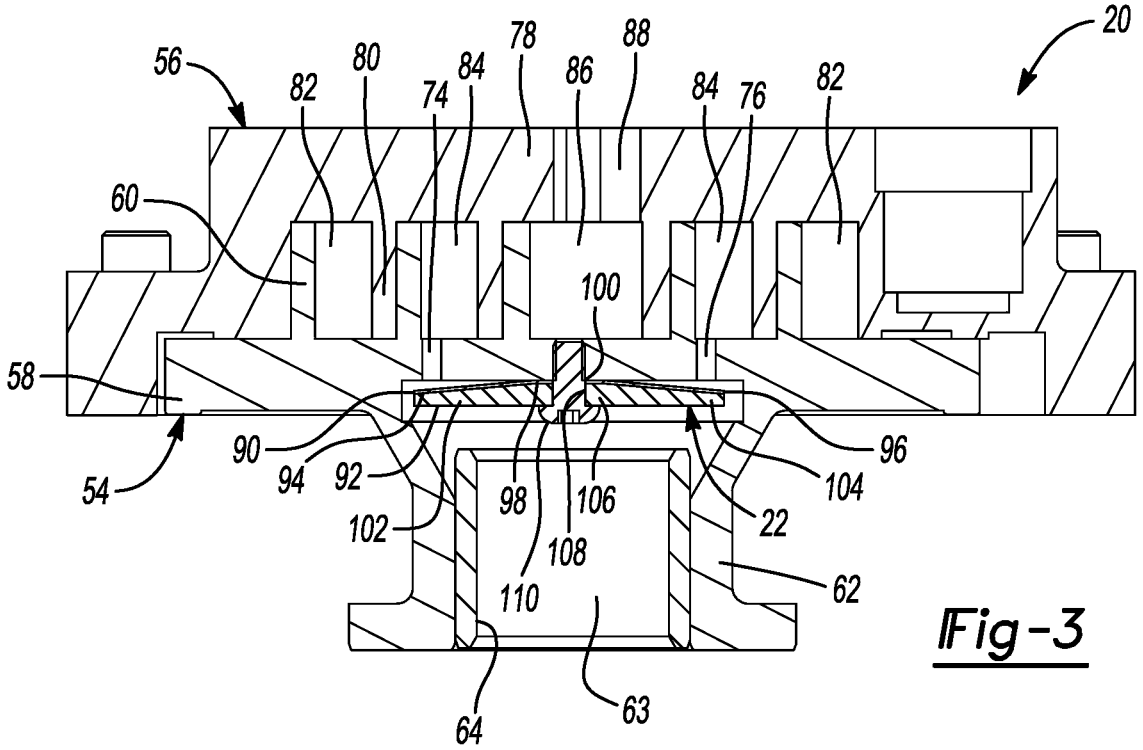
FIG. 3 is a cross-sectional view of a compression mechanism and the variable-volume-ratio valve assembly of the compressor of FIG. 1 with the valve member in an open position.
Figure 4:
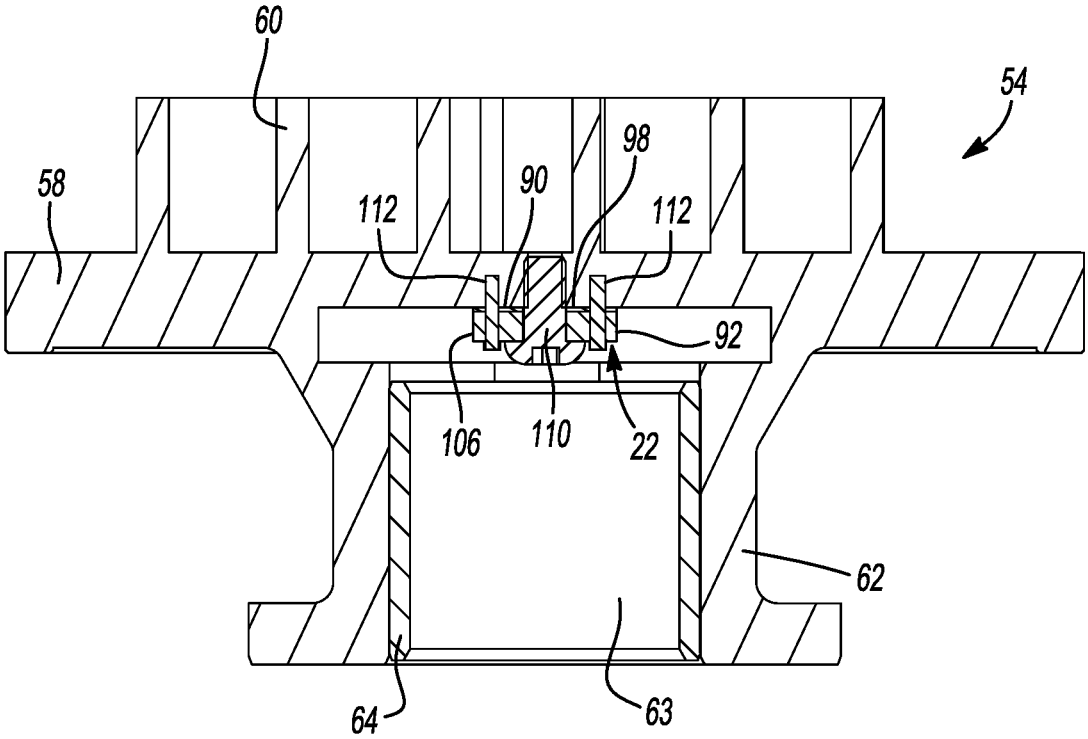
FIG. 4 is another cross-sectional view of a scroll of the compression mechanism and the variable-volume-ratio valve assembly.

The non-orbiting scroll 56 may include an end plate 78 and a spiral wrap 80 projecting downwardly from the end plate 78. The spiral wrap 80 may meshingly engage the spiral wrap 60 of the orbiting scroll 54, thereby creating a series of moving fluid pockets therebetween. The fluid pockets defined by the spiral wraps 60, 80 may decrease in volume as they move from a radially outer position 82 (FIG. 2) to a radially intermediate position 84 (FIG. 2) to a radially inner position 86 (FIG. 2) throughout a compression cycle of the compression mechanism 20. The inlet fitting 34 is fluidly coupled with a suction inlet in the end plate 78 and provides suction-pressure working fluid to the fluid pockets at the radially outer positions 82. The end plate 78 may include a discharge passage 88 in communication with one of the fluid pockets at the radially inner position 86 and allows compressed working fluid (at the high pressure) to flow into the discharge chamber 24. The first and second VVR ports 74, 76 are disposed radially outward relative to the discharge passage 88 and communicate with respective fluid pockets in the radially intermediate positions 84, as shown in FIG. 2.

As described above, the VVR valve assembly 22 may be disposed within the cavity 63 and may be mounted to the end plate 58 of the orbiting scroll 54. The VVR valve assembly 22 may include a valve member 90 and a retainer (backer plate) 92. The valve member 90 may be a thin and resiliently flexible elongated reed valve having a first end portion 94, and a second end portion 96, and a central portion 98 disposed between the first and second end portions 94, 96. An aperture 100 extends through the central portion 98. The retainer 92 may be a rigid elongated member having a first end portion 102, a second end portion 104, and a central portion 106 disposed between the first and second end portions 102, 104. An aperture 108 extends through the central portion 106. A fastener 110 (e.g., a bolt, rivet, etc.) may extend through the apertures 100, 108 of the valve member 90 and retainer 92 and may engage the end plate 58 of the orbiting scroll 54 to fixedly secure the retainer 92 and the central portion 98 of the valve member 90 to the end plate 58 (i.e., such that the valve member 90 is sandwiched between the retainer 92 and the end plate 58). One or more pins 112 (FIG. 4) (or one or more additional fasteners) may also extend through corresponding apertures in the retainer 92 and valve member 90 and into corresponding apertures in the end plate 58 to rotationally fix the retainer 92 and valve member 90 relative to the end plate 58.

The first and second end portions 102, 104 of the retainer may be tapered or angled to form gaps between distal ends of the first and second end portions 102, 104 and the end plate 58. The gaps provide clearance to allow the first and second end portions 94, 96 of the valve member 90 to bend (relative to the central portion 98) away from the end plate 58.

The VVR ports 74, 76 and the VVR valve assembly 22 are operable to prevent the compression mechanism 20 from over-compressing working fluid. Over-compression is a compressor operating condition where the internal compressor-pressure ratio of the compressor (i.e., a ratio of a pressure of a fluid pocket in the compression mechanism at a radially innermost position to a pressure of a fluid pocket in the compression mechanism at a radially outermost position) is higher than a pressure ratio of a climate-control system in which the compressor is installed (i.e., a ratio of a pressure at a high side of the climate-control system to a pressure of a low side of the climate-control system). In an over-compression condition, the compression mechanism is compressing fluid to a pressure higher than the pressure of fluid downstream of a discharge fitting of the compressor. Accordingly, in an over-compression condition, the compressor is performing unnecessary work, which reduces the efficiency of the compressor. The VVR valve assembly 22 of the present disclosure may reduce or prevent over-compression by selectively venting the fluid pockets at the radially intermediate positions 84 to the discharge chamber 24 (via the VVR ports 74, 76 and the cavity 63) when the pressure within such fluid pockets has exceeded (or sufficiently exceeded) the pressure in the discharge chamber 24.

When fluid pressure within fluid pockets at the radially intermediate positions 84 are sufficiently higher (i.e., higher by a predetermined value determined based on the spring rate of the valve member 90) than the fluid pressure within the discharge chamber 24, the fluid pressure within the fluid pockets at the radially intermediate positions 84 can bend the end portions 94, 96 of the valve member 90 away from the end plate 58 to an open position (shown in FIG. 3) to open the VVR ports 74, 76 and allow communication between the VVR ports 74, 76 and the cavity 63. That is, while the VVR ports 74, 76 are open (i.e., while the end portions 94, 96 are the open position), working fluid in the fluid pockets at the radially intermediate positions 84 can flow into the discharge chamber 24 (via the VVR ports 74, 76 and the cavity 63). When the fluid pressures within fluid pockets at the radially intermediate positions 84 are less than, equal to, or not sufficiently higher than the fluid pressure within the discharge chamber 24, the end portions 94, 96 of the valve member 90 will return to a closed position (shown in FIG. 2) (i.e., end portions 94, 96 return to their normal shapes) and seal against the end plate 58 to restrict or prevent communication between the cavity 63 and the VVR ports 74, 76.

It will be appreciated that the end portions 94, 96 can move between the open and closed positions together or independently of each other based on the fluid pressures within the respective fluid pockets to which the respective VVR ports 74, 76 are exposed. In other words, one of the end portions 94, 96 could be in the open position while the other of the end portions 94, 96 could be in the closed position.

Figure 5:
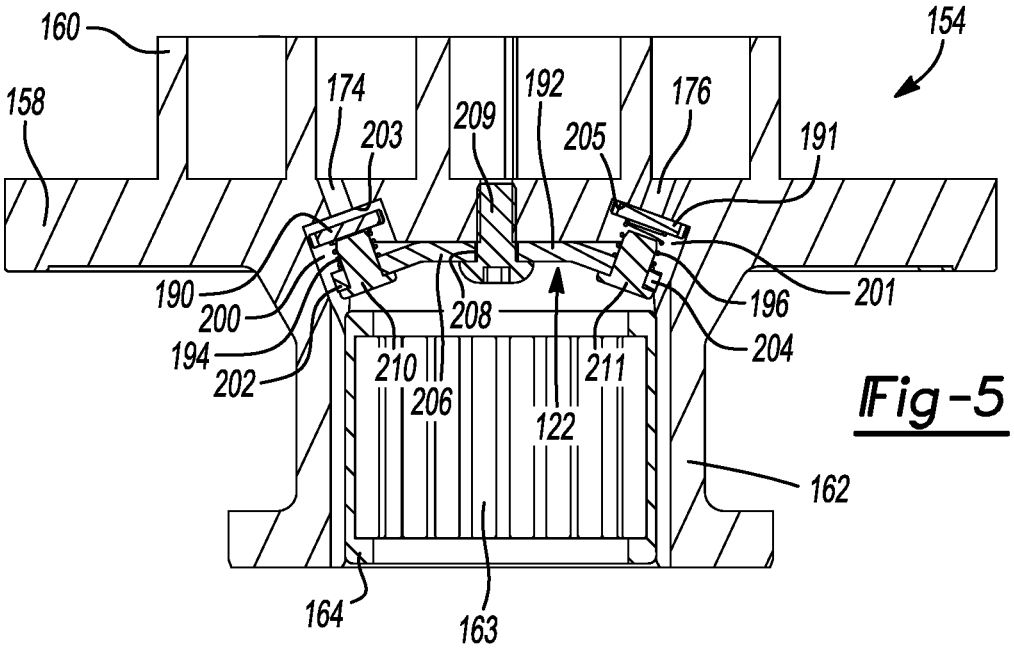
FIG. 5 is a cross-sectional view of another configuration of a scroll another configuration of a variable-volume-ratio valve assembly according to the principles of the present disclosure.
Figure 6:
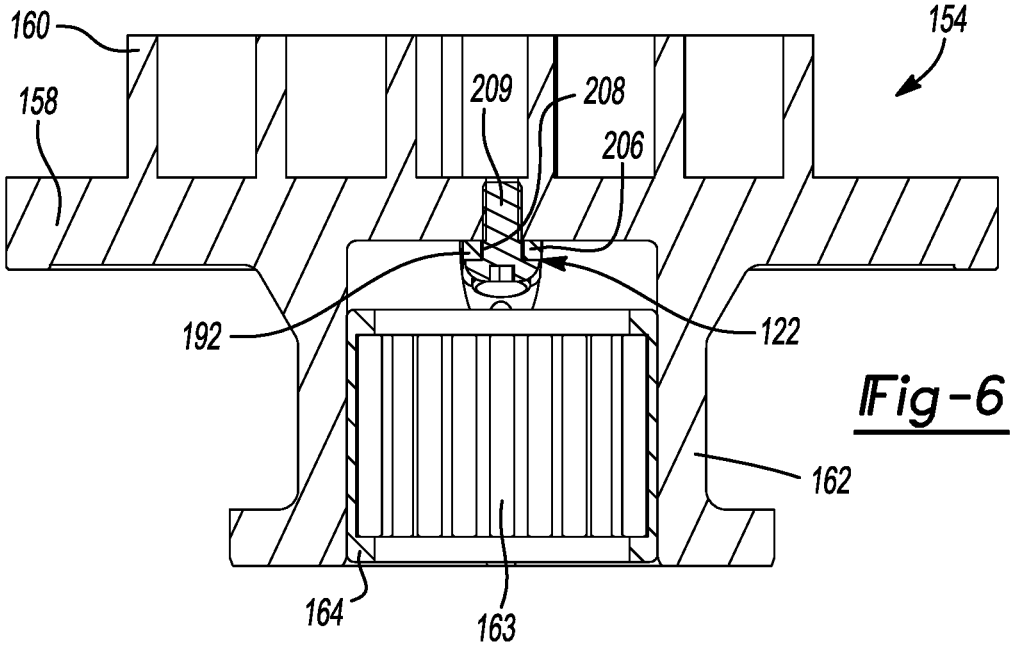
FIG. 6 is another cross-sectional view of the scroll and variable-volume-ratio valve assembly of FIG. 5.
Figure 7:
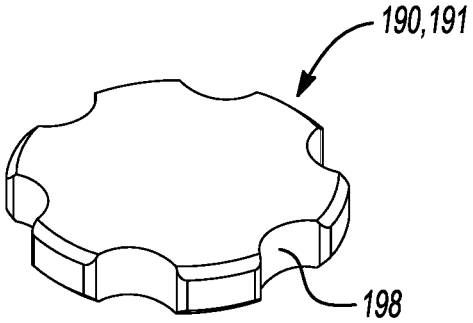
FIG. 7 is a perspective view of a valve member of the variable-volume-ratio valve assembly of FIG. 5.

Referring now to FIGS. 5-7, another VVR valve assembly 122 and another orbiting scroll 154 are provided. The VVR valve assembly 122 and orbiting scroll 154 could be incorporated into the compressor 10 instead of the VVR valve assembly 22 and orbiting scroll 54. The structure and function of VVR valve assembly 122 and orbiting scroll 154 can be similar or identical to that of the VVR valve assembly 22 and orbiting scroll 54 described above, apart from any exceptions described below. Therefore, some similar features and functions will not be described again in detail.

Like the orbiting scroll 54, the orbiting scroll 154 may include an end plate 158 having a spiral wrap 160 extending therefrom. An annular hub 162 may project downwardly from the end plate 158 and may include a cavity 163 in which a drive bearing 164, the drive bushing 66 (not shown in FIGS. 5-7) and the crank pin 52 (not shown in FIGS. 5-7) may be disposed. The cavity 163 is in communication with the discharge chamber 24 of the compressor 10. The end plate 158 of the orbiting scroll 154 may include one or more first VVR ports 174 and one or more second VVR ports 176. The first and second VVR ports 174, 176 may extend through the end plate 158 and are in selective fluid communication with the cavity 163 formed by the annular hub 162.

The VVR valve assembly 122 may be disposed within the cavity 163 and may be mounted to the end plate 158 of the orbiting scroll 154. The VVR valve assembly 122 may include a first valve member 190, a second valve member 191, a retainer 192, a first spring 194, and a second spring 196.

The first and second valve members 190, 191 may be disc-shaped members and may include one or more flow passages (cutouts) 198 formed in their peripheries, as shown in FIG. 7. The first valve member 190 may be movably received within a first recess 200 formed in the end plate 158. The first recess 200 may be generally aligned with and in communication with the first VVR port(s) 174. The second valve member 191 may be movably received within a second recess 201 formed in the end plate 158. The second recess 201 may be generally aligned with and in communication with the second VVR port(s) 176. Valve seats 203, 205 are formed at the end of respective recesses 200, 201 and surround respective VVR ports 174, 176.

The retainer 192 may be a rigid elongated member having a first end portion 202, a second end portion 204, and a central portion 206 disposed between the first and second end portions 202, 204. One or more fasteners 209 (e.g., bolts, rivets, etc.) may extend through one or more apertures 208 in the central portion 206 and may engage the end plate 158 to fixedly secure the retainer 192 to the end plate 158. The end portions 202, 204 of the retainer 192 may be angled relative to the central portion 206.

First and second pins 210, 211 may extend from respective end portions 202, 204 and may extend into the respective recesses 200, 201 and partially through respective springs 194, 196. The first spring 194 is disposed between and in contact with the first end portion 202 and the first valve member 190. The second spring 196 is disposed between and in contact with the second end portion 204 and the second valve member 191.

The valve members 190, 191 are movable within the recesses 200, 201 between an open position in which the valve members 190, 191 are spaced apart from the valve seats 203, 205 and closed positions in which the valve members 190, 191 are in contact with the valve seats 203, 205. The first and second springs 194, 196 bias the first and second valve members 190, 191 toward the closed position. In the closed position, the valve members 190, 191 restrict or prevent fluid flow from the VVR ports 174, 176 to the cavity 163. In the open position, the valve members 190, 191 allow working fluid to flow from the VVR ports 174, 176 into the recesses 200, 201, through the flow passages 198 in the valve members 190, 191 and into the cavity 163 and into the discharge chamber 24.

It will be appreciated that the valve members 190, 191 can move between the open and closed positions together or independently of each other based on the fluid pressures within the respective fluid pockets to which the respective VVR ports 174, 176 are exposed. In other words, as shown in FIG. 5, one of the valve members 190, 191 could be in the open position while the other of the valve members 190, 191 could be in the closed position.

Figure 8:
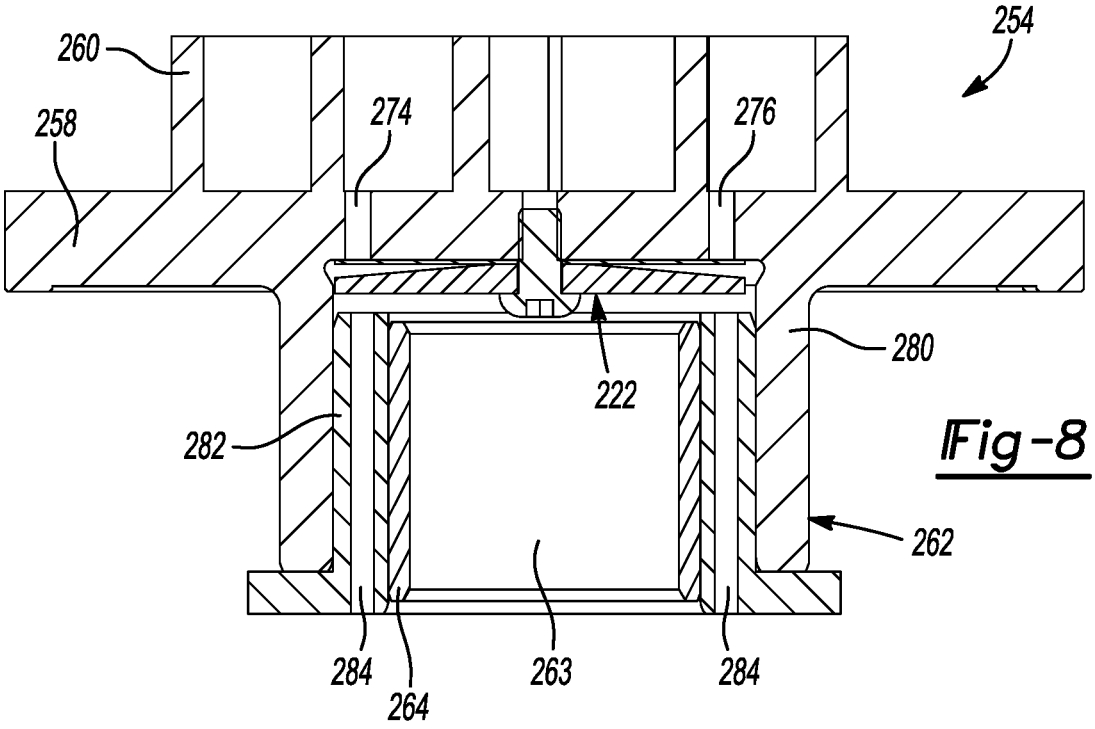
FIG. 8 is a cross-sectional view of yet another configuration of a scroll and variable-volume-ratio valve assembly according to the principles of the present disclosure.
Figure 9:
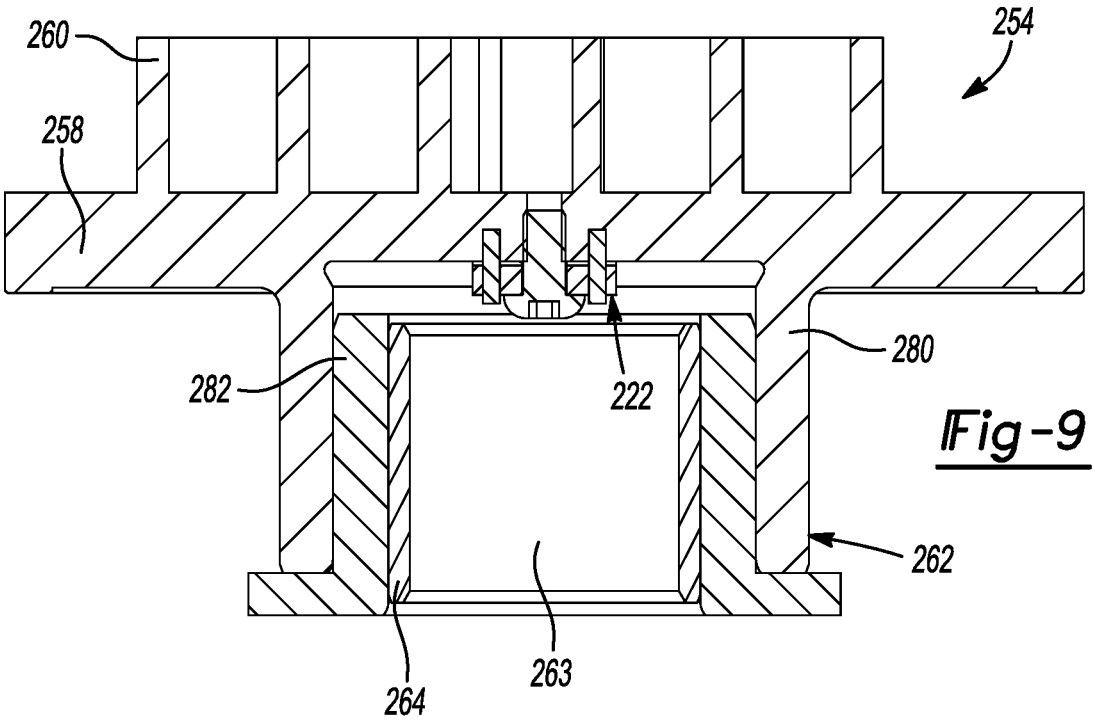
FIG. 9 is another cross-sectional view of the scroll and variable-volume-ratio valve assembly of FIG. 8.

Referring now to FIGS. 8 and 9, another VVR valve assembly 222 and another orbiting scroll 254 are provided. The VVR valve assembly 222 and orbiting scroll 254 could be incorporated into the compressor 10 instead of the VVR valve assembly 22 and orbiting scroll 54. The structure and function of VVR valve assembly 222 and orbiting scroll 254 can be similar or identical to that of the VVR valve assembly 22 and orbiting scroll 54 described above, apart from any exceptions described below. Therefore, some similar features and functions will not be described again in detail.

Like the orbiting scroll 54, the orbiting scroll 254 may include an end plate 258 having a spiral wrap 260 extending therefrom. An annular hub 262 may project downwardly from the end plate 258 and may include a cavity 263 in which a drive bearing 264, the drive bushing 66 (not shown in FIGS. 8 and 9) and the crank pin 52 (not shown in FIGS. 8 and 9) may be disposed. Like the orbiting scroll 54, the end plate 258 of the orbiting scroll 254 may include one or more first VVR ports 274 and one or more second VVR ports 276. The VVR valve assembly 222 may operate in the same manner as the VVR valve assembly 22 to control fluid flow through VVR ports 274, 276.

The hub 262 may be a two-piece hub including a first annular member 280 and a second annular member 282. The first annular member 280 may be integrally formed with the end plate 258. The second annular member 282 may be partially received within the first annular member 280 and may receive the drive bearing 264. In some configurations, the second annular member 282 may include one or more flow passages 284 that extend through the second annular member 282, as shown in FIG. 8.

Figure 10:
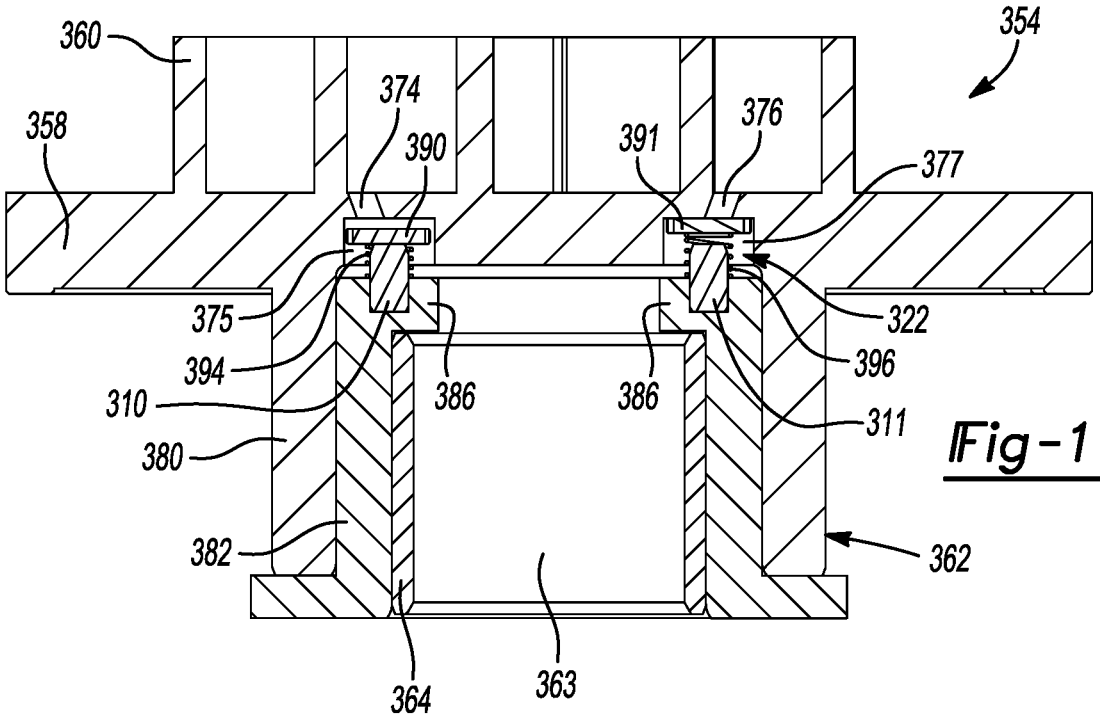
FIG. 10 is a cross-sectional view of yet another configuration of a scroll and variable-volume-ratio valve assembly according to the principles of the present disclosure.
Figure 11:
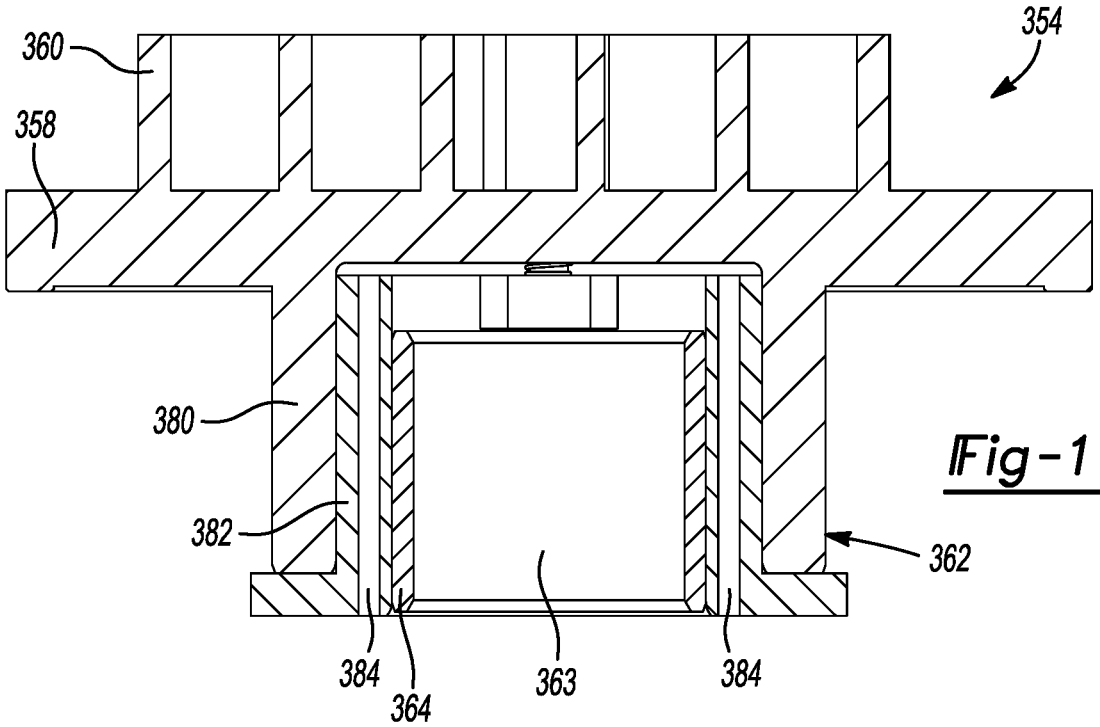
FIG. 11 is another cross-sectional view of the scroll and variable-volume-ratio valve assembly of FIG. 10.

Referring now to FIGS. 10 and 11, another VVR valve assembly 322 and another orbiting scroll 354 are provided. The VVR valve assembly 322 and orbiting scroll 354 could be incorporated into the compressor 10 instead of the VVR valve assembly 22 and orbiting scroll 54. The structure and function of the orbiting scroll 354 can be similar or identical to that of the orbiting scroll 254 described above, apart from any exceptions described below. The structure and function of the VVR valve assembly 322 can be similar or identical to that of the VVR valve assembly 122 described above, apart from any exceptions described below. Therefore, some similar features and functions will not be described again in detail.

Like the orbiting scroll 254, the orbiting scroll 354 may include an end plate 358 having a spiral wrap 360 extending therefrom. An annular hub 362 may project downwardly from the end plate 358 and may include a cavity 363 in which a drive bearing 364, the drive bushing 66 (not shown in FIGS. 10 and 11) and the crank pin 52 (not shown in FIGS. 10 and 11) may be disposed. Like the orbiting scroll 254, the end plate 358 of the orbiting scroll 354 may include one or more first VVR ports 374, one or more second VVR ports 376, a first recess 375, and a second recess 377. The first recess 375 may be in communication with and generally aligned with the first VVR port(s) 374. The second recess 377 may be in communication with and generally aligned with the second VVR port(s) 376. The VVR valve assembly 322 may operate in the same or similar manner as the VVR valve assembly 122 to control fluid flow through VVR ports 374, 376.

The hub 362 may be a two-piece hub including a first annular member 380 and a second annular member 382. The first annular member 380 may be integrally formed with the end plate 358. The second annular member 382 may be partially received within the first annular member 380 and may receive the drive bearing 364. In some configurations, the second annular member 382 may include one or more flow passages 384 that extend through the second annular member 382, as shown in FIG. 11. In some configurations, an upper axial end of the second annular member 382 (i.e., the end adjacent the end plate 358) may include tabs 386 that extend radially inwardly therefrom, as shown in FIG. 10.

Like the VVR valve assembly 122, the VVR valve assembly 322 may include first and second valve members 390, 391, first and second springs 394, 396, and first and second pins 310, 311. The valve members 390, 391 may be similar or identical to the valve members 190, 191. The tabs 386 of the second annular member 382 of the hub 362 may be fixed relative to the end plate 358 and may take the place of (and have the same or similar function as the retainer 192). The pins 310, 311 may be mounted to respective tabs 386, may extend into respective recesses 375, 377, may extend partially through respective springs 394, 396, and may be in contact with respective valve members 390, 391. Like the valve members 190, 191, the valve members 390, 391 are movable within the recesses 375, 377 between open and closed positions to control fluid flow through the VVR ports 374, 376.

Figure 12:
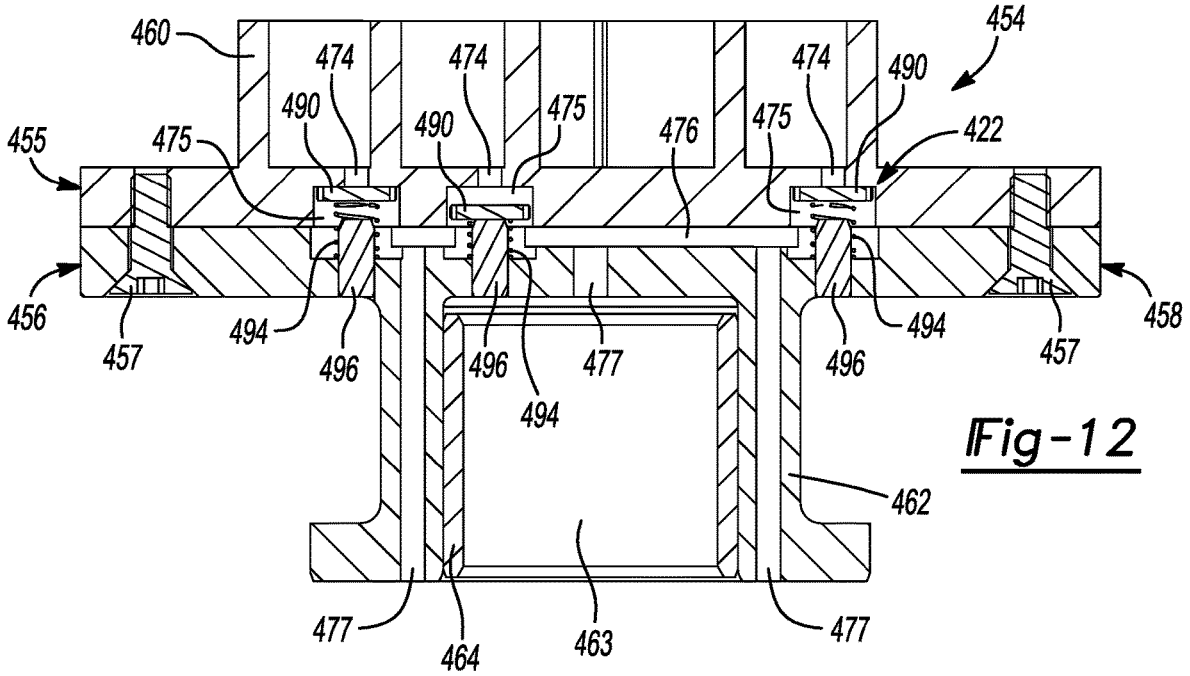
FIG. 12 is a cross-sectional view of yet another configuration of a scroll and variable-volume-ratio valve assembly according to the principles of the present disclosure.
Figure 13:
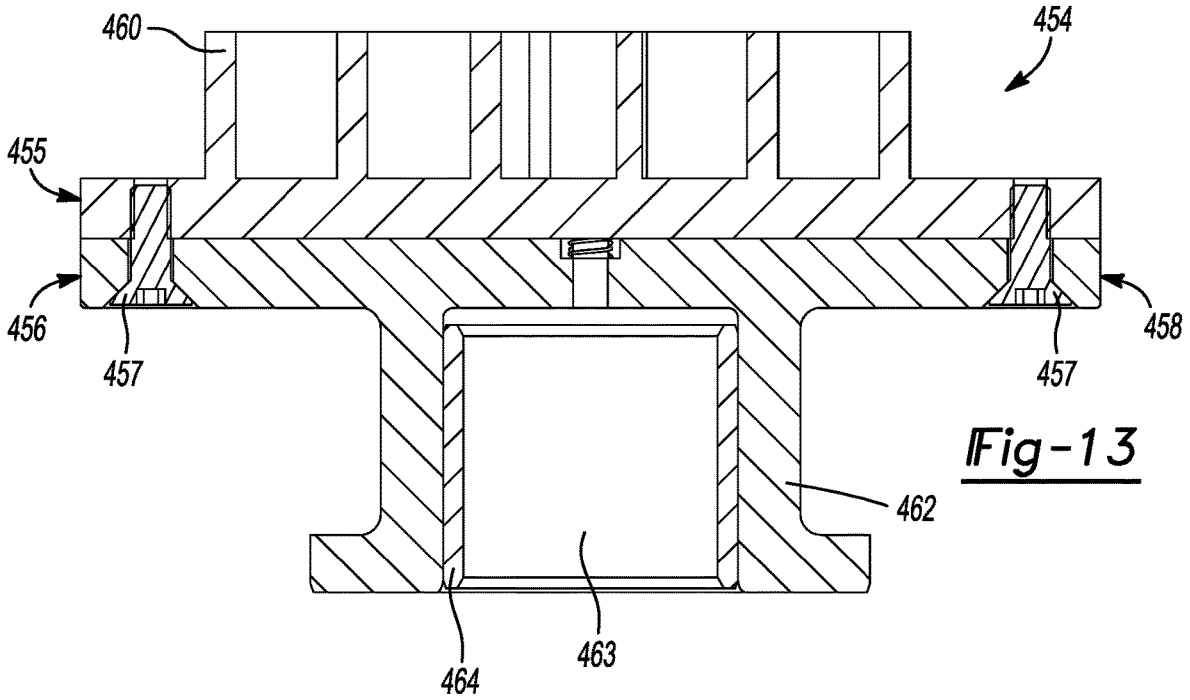
FIG. 13 is another cross-sectional view of the scroll and variable-volume-ratio valve assembly of FIG. 12.

Referring now to FIGS. 12 and 13, another VVR valve assembly 422 and another orbiting scroll 454 are provided. The VVR valve assembly 422 and orbiting scroll 454 could be incorporated into the compressor 10 instead of the VVR valve assembly 22 and orbiting scroll 54. The structure and function of the orbiting scroll 454 can be similar or identical to that of the orbiting scroll 54 described above, apart from any exceptions described below. The structure and function of the VVR valve assembly 422 can be similar or identical to that of the VVR valve assembly 322 described above, apart from any exceptions described below. Therefore, some similar features and functions will not be described again in detail.

Like the orbiting scroll 54, the orbiting scroll 454 may include an end plate 458 having a spiral wrap 460 extending therefrom. An annular hub 462 may project downwardly from the end plate 458 and may include a cavity 463 in which a drive bearing 464, the drive bushing 66 (not shown in FIGS. 12 and 13) and the crank pin 52 (not shown in FIGS. 12 and 13) may be disposed.

The orbiting scroll 454 may include a first portion 455 and a second portion 456 attached to the first portion 455 by a plurality of fasteners 457. The first portion 455 may include the spiral wrap 460 and a portion of the end plate 458 having a plurality of VVR ports 474 and a plurality of recesses 475. Like recesses 200, 201, the recesses 475 define valve seats. Each recess 475 is in communication with and generally aligned with a respective VVR port 474. The second portion 456 may include another portion of the end plate 458 and the annular hub 462. The portion of the end plate 458 defined by the second portion 456 may include a radially extending flow passage 476 in communication with the recesses 475 and one or more axially extending flow passages 477 in communication with the radially extending flow passage 476. In the configuration shown FIG. 12, one of the axially extending flow passages 477 opens into the cavity 463 and the other axially extending flow passages 477 extending axially through the hub 462 and are disposed radially outward relative to the cavity 463. The axially extending flow passages 477 are directly or indirectly in communication with the discharge chamber 24.

The VVR valve assembly 422 may include a plurality of valve members 490 (which may be similar or identical to the valve members 190, 191), a plurality of springs 494 (which may be similar or identical to the springs 194, 196), and a plurality of pins 496 (which may be similar or identical to the pins 210, 211). The pins 496 are mounted to the second portion 456 of the orbiting scroll 454 and may extend partially into respective recesses 475. The valve members 490 are movable within recesses 475 between open and closed positions to control fluid flow between the VVR ports 474 and the flow passages 476, 477 in the same or similar manner in which valve members 190, 191 control fluid flow between VVR ports 174, 176 and the cavity 163.

Figure 14:
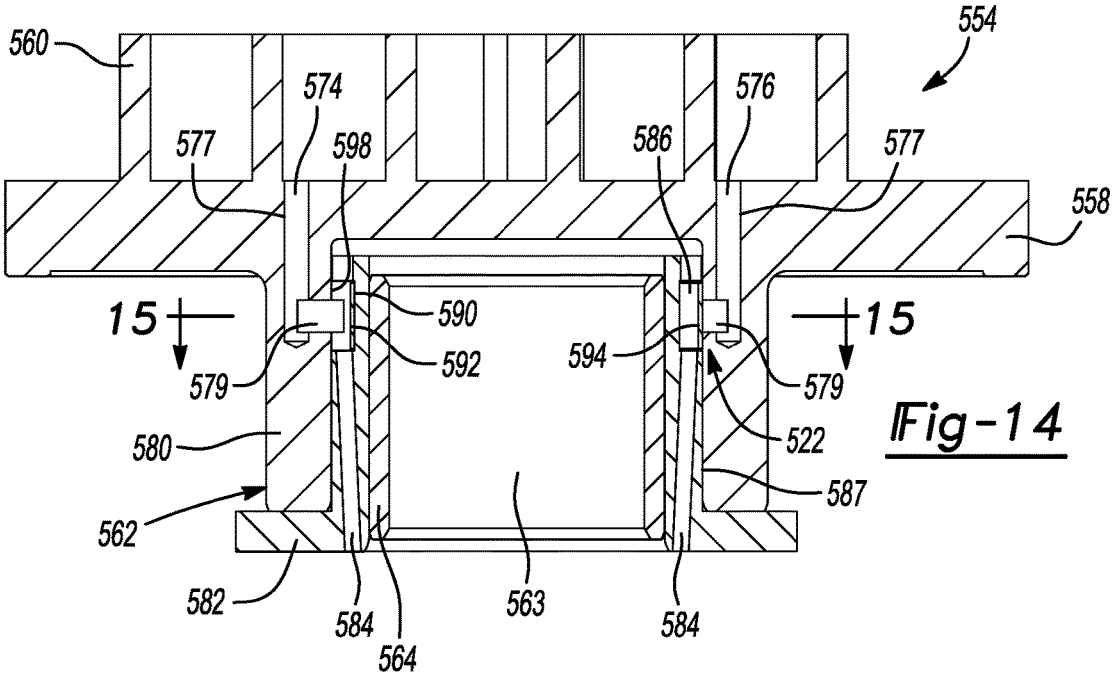
FIG. 14 is a cross-sectional view of yet another configuration of a scroll and variable-volume-ratio valve assembly according to the principles of the present disclosure.
Figure 15:
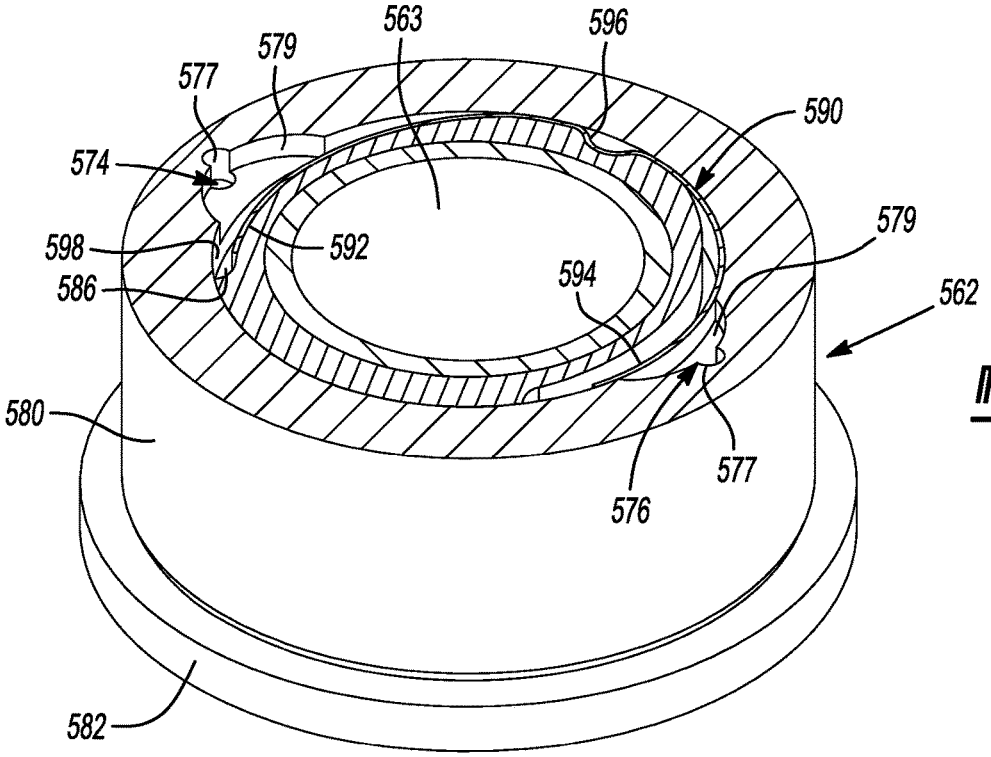
FIG. 15 is a cross-sectional perspective view a portion of the scroll and the variable-volume-ratio valve assembly of FIG. 14.
Figure 16:
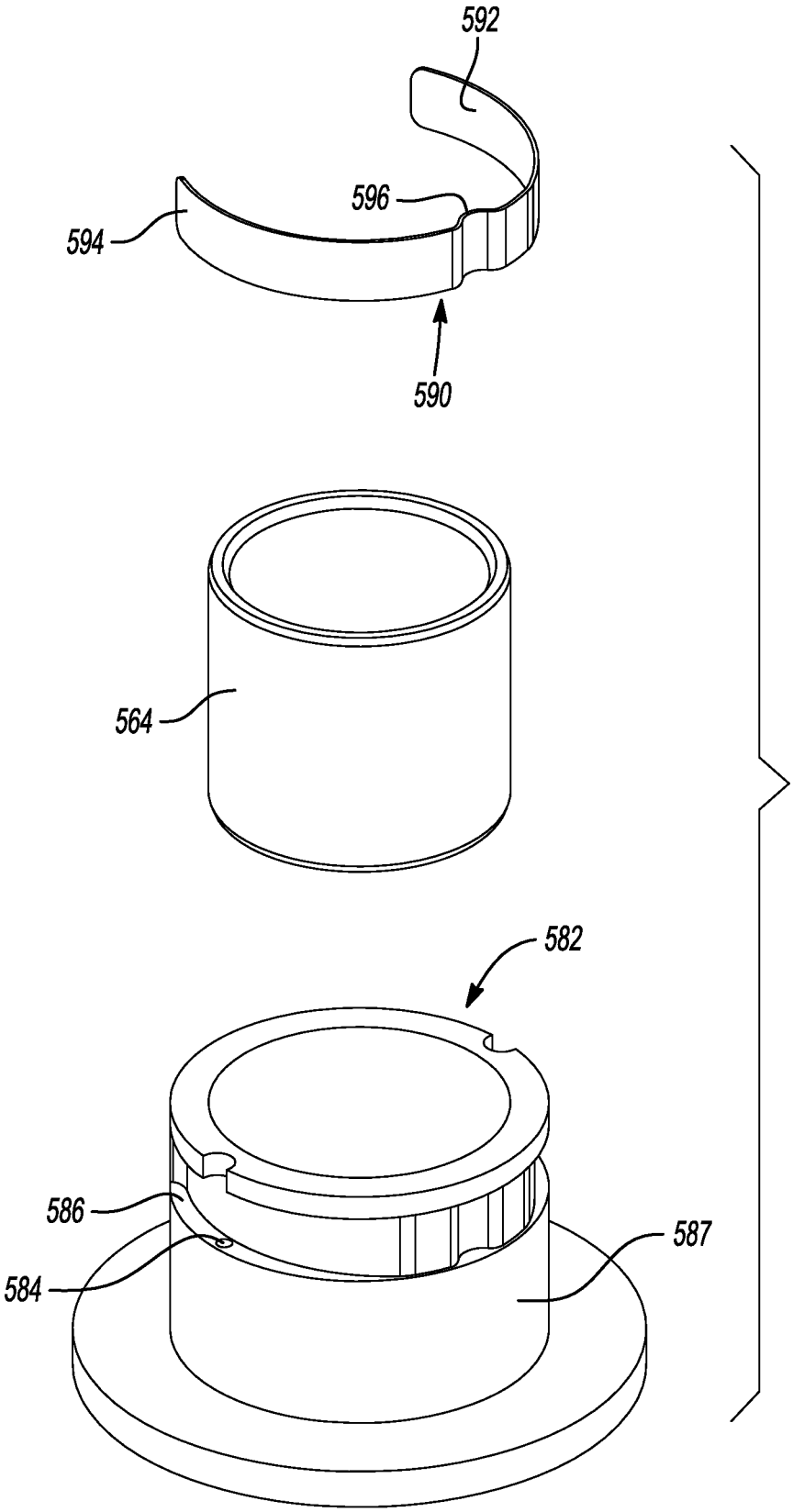
FIG. 16 is an exploded view of the variable-volume-ratio valve assembly of FIG. 14.

Referring now to FIGS. 14-16, another VVR valve assembly 522 and another orbiting scroll 554 are provided. The VVR valve assembly 522 and orbiting scroll 554 could be incorporated into the compressor 10 instead of the VVR valve assembly 22 and orbiting scroll 54. The structure and function of the orbiting scroll 554 can be similar or identical to that of the orbiting scroll 54 or 254 described above, apart from any exceptions described below. Therefore, some similar features and functions will not be described again in detail.

Like the orbiting scroll 254, the orbiting scroll 554 may include an end plate 558 having a spiral wrap 560 extending therefrom. An annular hub 562 may project downwardly from the end plate 558 and may include a cavity 563 in which a drive bearing 564, the drive bushing 66 (not shown in FIGS. 14-16) and the crank pin 52 (not shown in FIGS. 14-16) may be disposed. Like the orbiting scroll 254, the end plate 558 of the orbiting scroll 554 may include one or more first VVR ports 574, and one or more second VVR ports 576. Each of the first and second VVR ports 574, 576 may include an axially extending portion 577 and a radially extending portion 579 that extends radially inward from the axially extending portion 577 to the cavity 563. The VVR valve assembly 522 controls fluid flow through VVR ports 574, 576.

The hub 562 may be a two-piece hub including a first annular member 580 and a second annular member 582. The first annular member 580 may be integrally formed with the end plate 558. A portion of the axially extending portions 577 of the VVR ports 574, 576 may extend through the first annular member 580, and the radially extending portions 579 of the VVR ports 574, 576 extend through a portion of the first annular member 580. The second annular member 582 may be partially received within the first annular member 580 and may receive the drive bearing 564. The second annular member 582 may include one or more flow passages 584 that extend through the second annular member 582, as shown in FIG. 14. As shown in FIG. 16, a contoured recess 586 is formed in an outer diametrical surface 587 of the second annular member 582. The recess 586 is open to the flow passages 584. The recess 586 partially encircles the drive bearing 564 (i.e., the recess 586 extends partially around the circumference of the crank pin 52).

The VVR valve assembly 522 may include a valve member 590 that is received within the recess 586 of the second annular member 582. The valve member 590 may be a generally C-shaped, thin and resiliently flexible reed valve having a first end portion 592, and a second end portion 594, and a central portion 596 disposed between the first and second end portions 592, 594. The contoured recess 586 of the second annular member 582 may be shaped to fixedly receive the central portion 596 and movably receive the first and second end portions 592, 594 such that the first and second end portions 592, 594 are able to flex between outward and inward between closed positions (in which the end portions 592, 594 are in contact with an inner diametrical surface 598 of the first annular member 580) and open positions (in which the end portions 592, 594 are spaced apart from the inner diametrical surface 598 of the first annular member 580).

In FIGS. 14 and 15, the first end portion 592 is shown in the open position in which the first end portion 592 has moved (e.g., flexed) inward away from the inner diametrical surface 598 to allow communication between the first VVR port 574 and one of the flow passages 584 (the flow passages 584 are in communication with the cavity 563 and the discharge chamber 24). In FIGS. 14 and 15, the second end portion 594 is shown in the closed position in which the second end portion 594 has moved (e.g., unflexed) outward into contact with the inner diametrical surface 598 to close off the second VVR port 576 to restrict or prevent communication between the second VVR port 576 and the flow passages 584 (thus restricting or preventing communication between the second VVR port 576 and the discharge chamber 24). It will be appreciated that the end portions 592, 594 of the valve member 590 can move between the open and closed positions together or independently of each other based on the fluid pressures within the respective fluid pockets to which the respective VVR ports 574, 576 are exposed.

Figure 17:
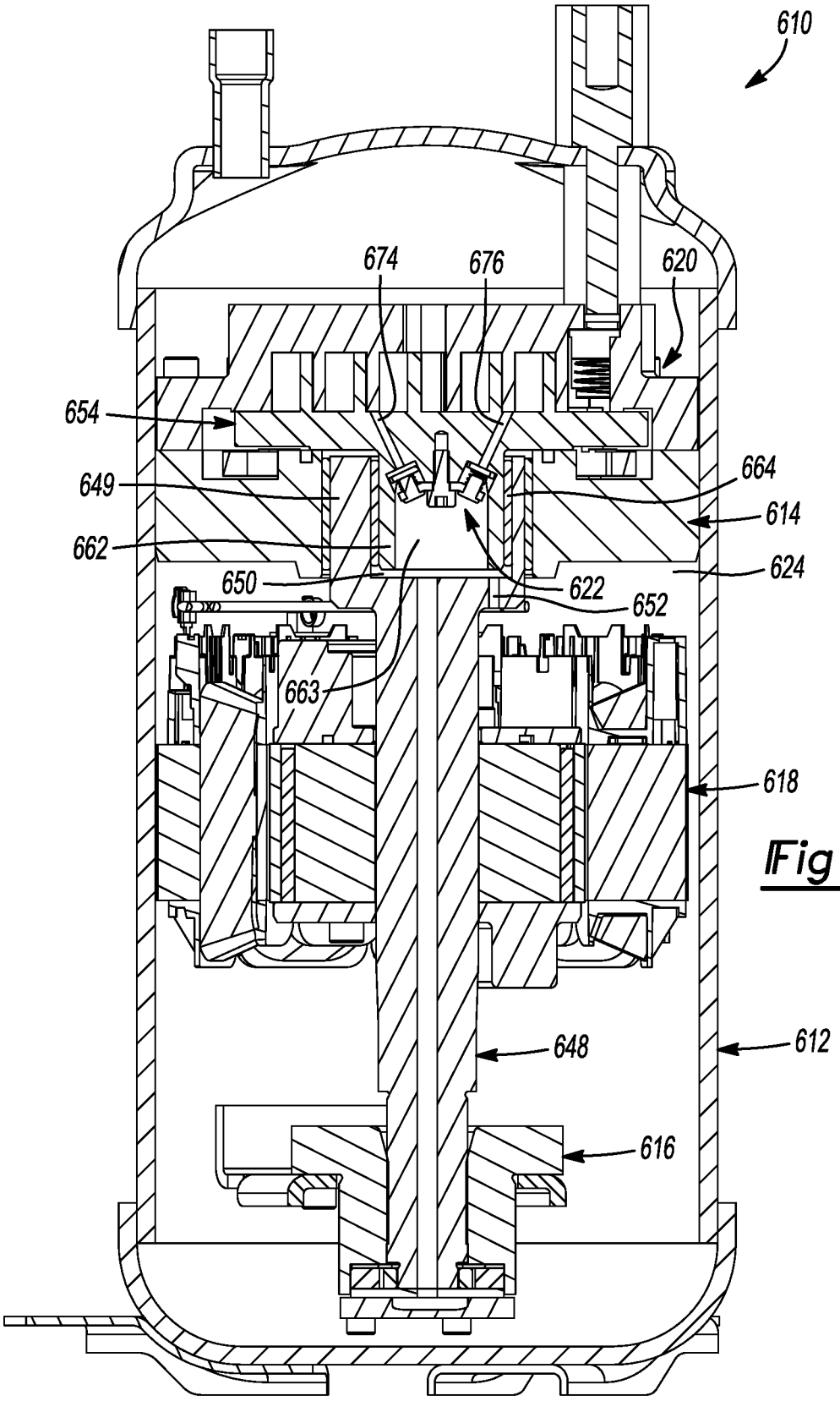
FIG. 17 is a cross-sectional view of another compressor having a variable-volume-ratio valve assembly according to the principles of the present disclosure.

Referring now to FIG. 17, another compressor 610 is provided. The structure and function of the compressor 610 may be similar or identical to that of the compressor 10 described above, apart from differences noted below and/or shown in the figures. Therefore, similar features will not be described again in detail.

Like the compressor 10, the compressor 610 may be a high-side scroll compressor including a hermetic shell assembly 612, a first and second bearing assemblies 614, 616, a motor assembly 618, a compression mechanism 620, and a variable-volume-ratio (VVR) valve assembly 622. The first bearing assembly 614 may be generally similar to the first bearing assembly 14 (i.e., the first bearing assembly 614 is fixed to the shell assembly 612, rotationally supports a driveshaft 648, and axially supports an orbiting scroll 654).

The driveshaft 648 may include an end portion (e.g., a collar portion) 649 having an eccentric recess 650 that receives a drive bearing 664 and a hub 662 of the orbiting scroll 654. The end portion 649 may include a flow passage 652 that provides communication between a discharge chamber 624 of the compressor 610 and a cavity 663 in the hub 662 (i.e., to provide communication between VVR ports 674, 676 and the discharge chamber 624).

The VVR valve assembly 622 can be similar or identical to any of the VVR valve assemblies 22, 122, 322, 422, 522 described above. The orbiting scroll 654 can be similar to any of the orbiting scrolls 54, 154, 254, 354, 454, 554 described above.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly defining a discharge chamber;

a non-orbiting scroll disposed within the discharge chamber and including a first end plate and a first spiral wrap extending from the first end plate;

an orbiting scroll disposed within the discharge chamber and including a second end plate and a second spiral wrap extending from the second end plate, the first and second spiral wraps meshing with each other to define a plurality of fluid pockets therebetween, the fluid pockets movable among a radially outermost position, a radially intermediate position, and a radially innermost position, the second end plate including a variable-volume-ratio port extending therethrough and selectively communicating with one of the fluid pockets at the radially intermediate position; and a variable-volume-ratio valve assembly mounted to the orbiting scroll and including a valve member that is movable relative to the orbiting scroll between an open position allowing communication between the variable-volume-ratio port and the discharge chamber and a closed position restricting communication between the variable-volume-ratio port and the discharge chamber, wherein the first end plate of the non-orbiting scroll includes a discharge passage in communication with the discharge chamber and one of the fluid pockets at the radially innermost position, wherein the variable-volume-ratio port is disposed radially outward relative to the discharge passage, and wherein when the valve member is in the open position, fluid flows from the variable-volume-ratio port to the discharge chamber without flowing through the discharge passage in the non-orbiting scroll and without flowing back into any of the fluid pockets.

2. The compressor of claim 1, wherein the second end plate includes an annular hub extending from a side of the second end plate opposite the second spiral wrap, wherein the annular hub defines a cavity in which the variable-volume-ratio valve assembly is at least partially disposed.

3. The compressor of claim 2, further comprising a driveshaft engaging the annular hub and driving the orbiting scroll.

4. The compressor of claim 3, wherein the driveshaft includes a crank pin disposed within the cavity.

5. The compressor of claim 4, further comprising a bearing disposed within the cavity and receiving the crank pin.

6. The compressor of claim 4, further comprising a bearing disposed within the cavity and receiving the crank pin, wherein the annular hub includes a flow passage extending therethrough, and wherein the flow passage is disposed radially outward relative to the bearing and at least partially defines a flow path extending from the variable-volume-ratio port to the discharge chamber.

7. The compressor of claim 6, wherein the annular hub is a two-piece hub including a first annular member and a second annular member, wherein the second annular member is at least partially received within the first annular member and receives the bearing.

8. The compressor of claim 3, wherein the variable-volume-ratio valve assembly includes a retainer disposed within the cavity and fixedly mounted to the second end plate.

9. The compressor of claim 8, wherein the valve member is a reed valve that is sandwiched between the retainer and the second end plate, and wherein the reed valve bends between the open and closed positions.

10. The compressor of claim 9, wherein the second end plate includes another variable-volume-ratio port, wherein the valve member selectively opens and closes the variable-volume-ratio ports, and wherein the valve member is fixedly attached to the second end plate at a location radially between the variable-volume-ratio ports.

11. The compressor of claim 8, wherein the second end plate includes a recess disposed between and in communication with the variable-volume-ratio port and the cavity, and wherein the valve member is disposed within the recess and movable therein between the open and closed positions.

12. The compressor of claim 11, wherein the variable-volume-ratio valve assembly includes a spring disposed at least partially within the recess and between the valve member and the retainer, wherein the spring biases the valve member toward the closed position.

13. The compressor of claim 12, wherein the valve member is a disc-shaped member having a flow passage formed in its periphery.

14. The compressor of claim 12, wherein the second end plate includes another variable-volume-ratio port, and wherein the variable-volume-ratio valve assembly includes another spring and another valve member movably received within another recess that is in communication with the cavity and the another variable-volume-ratio port.

15. The compressor of claim 1, wherein the second end plate includes an annular hub extending from a side of the second end plate opposite the second spiral wrap, wherein the annular hub defines a cavity that receives a crank pin of a driveshaft, wherein the annular hub is a two-piece hub including a first annular member and a second annular member, wherein the second annular member is partially received within the first annular member and receives the crank pin, wherein the variable-volume-ratio valve assembly is mounted to the second annular member.

16. The compressor of claim 15, wherein the variable-volume-ratio valve assembly includes a spring disposed between the second annular member and the valve member and biasing the valve member toward the closed position.

17. The compressor of claim 16, wherein the valve member is a disc-shaped member having a flow passage formed in its periphery.

18. The compressor of claim 15, wherein the valve member is disposed radially between the first and second annular members and extends partially around the crank pin of the driveshaft.

19. The compressor of claim 18, wherein the variable-volume-ratio port extends through a portion of the first annular member.

20. The compressor of claim 19, wherein the valve member contacts an inner diametrical surface of the first annular member when the valve member is in the closed position.

21. The compressor of claim 20, wherein a portion of the valve member moves inward away from the inner diametrical surface of the first annular member when the valve member moves from the closed position to the open position.

22. The compressor of claim 1, wherein the orbiting scroll includes a first portion and a second portion attached to the first portion by a plurality of fasteners, wherein the first portion includes the second spiral wrap and a portion of the second end plate, wherein the second portion includes another portion of the second end plate and an annular hub that engages a driveshaft.

23. The compressor of claim 22, wherein the annular hub includes a flow passage in communication with the variable-volume-ratio port and the discharge chamber.

24. The compressor of claim 23, wherein the variable-volume-ratio valve assembly includes a spring disposed between the valve member and the second portion of the orbiting scroll, and wherein the spring biases the valve member toward a valve seat defined by the first portion of the orbiting scroll.

25. The compressor of claim 1, further comprising a driveshaft having an eccentric recess, wherein the second end plate includes an annular hub extending from a side of the second end plate opposite the second spiral wrap, wherein the annular hub defines a cavity in which the variable-volume-ratio valve assembly is at least partially disposed, and wherein the annular hub is received within the eccentric recess of the driveshaft.

26. The compressor of claim 25, wherein the driveshaft includes a flow passage in fluid communication with the cavity.

27. The compressor of claim 26, wherein when the valve member is in the open position, fluid from the variable-volume-ratio port flows into the cavity, and wherein fluid in the cavity flows into the discharge chamber via the flow passage in the driveshaft.

28. The compressor of claim 27, wherein the flow passage is disposed in a collar portion of the driveshaft, and wherein the collar portion is disposed at an axial end of the driveshaft and defines the eccentric recess.

* * * * *